US007110699B2

(12) United States Patent
Yoshizawa et al.

(10) Patent No.: US 7,110,699 B2
(45) Date of Patent: Sep. 19, 2006

(54) IMAGE FORMING APPARATUS AND PROCESS CARTRIDGE FOR USE IN THE SAME

(75) Inventors: Hideo Yoshizawa, Saitama (JP); Eisaku Murakami, Kanagawa (JP); Hiroyuki Nagashima, Kanagawa (JP); Yoshiyuki Kimura, Tokyo (JP); Hideki Zemba, Kanagawa (JP); Eiji Kurimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/247,139

(22) Filed: Oct. 12, 2005

(65) Prior Publication Data

US 2006/0029427 A1 Feb. 9, 2006

Related U.S. Application Data

(62) Division of application No. 10/665,825, filed on Sep. 22, 2003.

(30) Foreign Application Priority Data

Sep. 19, 2002 (JP) ..... 2002-272729
Nov. 21, 2002 (JP) ..... 2002-338450

(51) Int. Cl.
*G03G 21/00* (2006.01)

(52) U.S. Cl. ..... 399/149; 399/129; 399/353

(58) Field of Classification Search ..... 399/149, 399/150, 129, 128, 343, 353, 354, 71; 430/125
See application file for complete search history.

(56) References Cited

U.S. PATENT DOCUMENTS 3,910,697 A * 10/1975 Lanker ..... 430/125
5,107,303 A 4/1992 Miyamoto et al. ..... 399/349
5,237,375 A 8/1993 Michlin et al. ..... 399/274
5,315,357 A 5/1994 Kamijo et al. ..... 399/350
5,323,217 A 6/1994 Christy et al. ..... 399/296
5,394,228 A 2/1995 Godlove ..... 399/350
5,438,397 A * 8/1995 Okano et al. ..... 399/150
5,701,570 A * 12/1997 Takuma ..... 399/343
5,930,575 A * 7/1999 Fornalik et al. ..... 399/345
6,567,642 B1 * 5/2003 Marsh ..... 399/341
6,640,080 B1 10/2003 Endo et al. ..... 399/349
6,697,599 B1 2/2004 Scherdel ..... 399/350
6,799,012 B1 9/2004 Shakuto et al. ..... 399/357
2001/0026694 A1 * 10/2001 Sakaizawa et al. ..... 399/149 X
2002/0141771 A1 10/2002 Nishimura ..... 399/50
2003/0002896 A1 * 1/2003 Akiba ..... 399/353
2003/0219289 A1 * 11/2003 Kawahara et al. ..... 399/353 X (Continued)

FOREIGN PATENT DOCUMENTS

EP 0 472 401 2/1992

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of the present invention includes a sheet affixed at one edge portion and including a flat surface in the other edge portion. The flat surface is formed with a plurality of grooves each extending over the image forming range of a photoconductive drum perpendicularly to the direction in which the surface of the drum moves. The sheet is deformed such that the flat portion contacts the surface of the drum. In this condition, the downstream edges of the grooves in the above direction shave off the surface of the drum a plurality of times during one rotation of the drum, thereby obviating filming on the drum.

7 Claims, 14 Drawing Sheets

U.S. PATENT DOCUMENTS

| | | | | |
|---|---|---|---|---|
| 2003/0235424 | A1* | 12/2003 | Kawahara et al. | 399/71 |
| 2004/0187893 | A1* | 9/2004 | Maguire et al. | 134/8 |

FOREIGN PATENT DOCUMENTS

| | | | |
|---|---|---|---|
| JP | 58-126566 | | 7/1983 |
| JP | 06-138798 | A * | 5/1994 |
| JP | 8-137198 | | 5/1996 |
| JP | 8-137205 | | 5/1996 |
| JP | 9-211979 | | 8/1997 |
| JP | 11-190931 | | 7/1999 |
| JP | 2000-194242 | | 7/2000 |
| JP | 3091323 | B2 | 7/2000 |
| JP | 2000-242152 | | 9/2000 |
| JP | 2001-75448 | | 3/2001 |
| JP | 2001-117317 | | 4/2001 |
| JP | 2001-356614 | | 12/2001 |
| JP | 2002-108161 | | 4/2002 |

* cited by examiner

FIG. 4

| TONER MEAN CIRCULARITY | SPEND OBSERVATION TIME (MIN.) |
|---|---|
| 0.91 | 2040 |
| 0.92 | 3500 |
| 0.93 | 4300 |
| 0.95 | 4550 |
| 0.97 | 4600 |

FIG. 16

| KIND \ PRINTS | 30K | 40K | 50K | 60K | 70K | 80K | 90K | 100K |
|---|---|---|---|---|---|---|---|---|
| NORMAL | ○ | ○ | △ | × | × | × | × | × |
| LOOP | ○ | ○ | ○ | ○ | △ | × | × | × |
| NORMAL (URETHAN COAT) | ○ | ○ | ○ | ○ | △ | △ | × | × |
| LOOP (URETHAN COAT) | ○ | ○ | ○ | ○ | ○ | ○ | ○ | ○ |

IMAGE FORMING APPARATUS AND PROCESS CARTRIDGE FOR USE IN THE SAME

CROSS REFERENCE

This is a Divisional Application of Ser. No. 10/665,825, filed Sep. 22, 2003.

BACKGROUND OF THE INVENTION

1. Field of the Invention

The present invention relates to a copier, printer, facsimile apparatus or similar image forming apparatus and a process cartridge for use in the same.

2. Description of the Background Art

An image forming apparatus of the type using an electrostatic image transfer system is conventional and configured to form an electric field between a photoconductive drum or similar image carrier and an intermediate image transfer body, sheet conveyor or similar moving member for thereby transferring a toner image formed on the image carrier. In this type of image forming apparatus, some toner is left on the image carrier after the transfer of the toner image to a subject body, e.g., the intermediate image transfer body or a sheet or recording medium. If part of the image carrier on which such residual toner is present is subject to the next image formation, then irregular charging or similar defective charging occurs on the above part of the image carrier and lowers image quality. It is a common practice to remove the residual toner from the image carrier with a cleaning device facing the surface portion of the drum between an image transfer position and a charge position.

The problem with the cleaning device mentioned above is that it needs an extra space for accommodating a waste toner tank configured to store the residual toner collected from the image carrier and a recycling path along which the residual toner is conveyed to be reused, making the entire apparatus bulky. Particularly, a current trend in the imaging art is toward a tandem image forming apparatus that assigns a particular image carrier to each color in order to meet the increasing demand for high-speed color image formation. If the cleaning device is applied to this kind of image forming apparatus, then a particular cleaning device must be assigned to each of a plurality of image carriers, making the above problem more serious.

To solve the problem stated above, Japanese Patent No. 3,091,323, for example, discloses an image forming apparatus using a simultaneous developing and cleaning system that causes a developing device to collect the residual toner. More specifically, the developing device, originally expected to develop a latent image, is used as cleaning means at the same time, so that z, particular cleaning device does not have to be assigned to each image carrier. This contributes a great deal to the size reduction of the apparatus.

On the other hand, while a blade type of cleaning device configured to clean the surface of the image carrier with a cleaning blade is predominant today, a bladeless type of cleaning device is also extensively used. The bladeless type of cleaning device may use a brush roller for collecting the residual toner or a bias applying member for electrostatically collecting the residual toner. Further, a simultaneous developing and cleaning system configured to collect residual toner left or, the surface of an image carrier with a developing device: is known in the art, as taught in Japanese Patent No. 3,091,323.

The bladeless type of cleaning system, which rubs the image carrier more softly than the blade type of cleaning system, successfully extends the life of the image carrier. In addition, load exerted by the bladeless type of cleaning system on the image carrier is lighter than load exerted by the blade type of cleaning system, reducing drive load to act on a driveline assigned to the image carrier.

The simultaneous developing and cleaning system does not need the cleaning device because the developing device, originally not used for the purpose of cleaning, plays the role of cleaning means at the same time. The simultaneous developing and cleaning system is therefore advantageous in that it reduces the overall size of the apparatus.

Japanese Patent mentioned above further teaches a charging device for the above image forming apparatus that includes a charge roller held in contact with the image carrier for uniformly charging the image carrier. Conventional systems for uniformly charging an image carrier are generally classified into a contact or vicinity type of charging system using a charge roller or similar charging member contacting or adjoining the image carrier and a non-contact type of charging system using a corona charger or similar charger. The non-contact type of charging system has a problem that it produces ozone, NOx (nitrogen oxides) and other discharge products, which are undesirable from the environment standpoint. In this respect, the contact or vicinity type of charging system, which produces a minimum of discharge products, is superior to the contact or vicinity type of charging system. Presumably, therefore, the apparatus taught in the above document promotes both of the size reduction of the apparatus and the reduction of discharge products.

However, the apparatus, using the simultaneous developing and cleaning system and contact or vicinity type of charging system has the following problem left unsolved. Before the residual toner present on the image carrier is conveyed to a developing zone, it contacts and deposits on the charging member, obstructing uniform charging. This prevents the charging member from charging the surface of the image carrier to an expected potential or causes irregular charging or similar defective charging to occur, resulting in short image density, background contamination and other defects. This problem is not particular to the apparatus using the simultaneous developing and cleaning system, but arises so long as the residual toner is conveyed to a position where the image carrier and charging member contact each other without being removed from the image carrier.

Pending Japanese Patent Application No. 2002-254142 discloses an image forming apparatus configured to solve the problem stated above. The apparatus taught in this document includes a brush member or similar temporary holding means for collecting and temporarily holding, among toner grains left on an image carrier after image transfer, toner grains charged to polarity opposite to toner grains of regular polarity, which is identical with the polarity of a charge bias, thereby preventing the toner grains of opposite polarity from depositing on a charging member. Subsequently, the temporary holding means returns the above toner grains to the image carrier at preselected timing between consecutive image formation. The toner grains thus returned to the image carrier are collected by a developing device or transferred to a subject body of image transfer or a member for conveying the subject body.

In the apparatus described above, when the toner grains returned to the image carrier pass a charging zone, a charge bias is interrupted or a charging member is released from the image carrier, preventing the toner grains from depositing on the charging member. On the other hand, the toner grains of negative or regular polarity, also included in the residual toner grains on the image carrier, remain on the image carrier without being transferred to the charging member. In addition, the toner grains of regular polarity are conveyed to a developing zone during the next image forming step and therefore collected by carrier grains included in a developer and contribute to development. It follows that the toner grains of regular polarity do not adversely effect the image forming step.

In the case where the charge bias and toner grains of regular polarity are different in polarity from each other, the toner grains of regular polarity will bring about the problem stated earlier.

Further, the apparatus stated above does not need a blade type of cleaning device, as distinguished from a blade type of cleaning device. More specifically, a brush member, serving as the temporary holding means rubs the surface of the image carrier in place of a cleaning blade and has therefore the advantages stated previously.

However, the bladeless type of cleaning system has a problem to be described hereinafter. Silica, zinc stearate and other additives contained in toner grains sometimes part from the toner grains due to, e.g., mechanical stresses acting during image formation. If such additives parted from the toner grains are pressed against the image carrier by a developer in a developing zone or by the brush member over a long time, then the additives adhere to the image carrier in the form of a thin film. This phenomenon is generally referred to as filming. Filming weakens the adhesion of the toner grains to the image carrier and thereby blurs or otherwise disfigures an image.

The additives, forming the film on the image carrier and electrically neutralized, cannot be electrostatically removed, but can be mechanically removed, as determined by experiments. The blade type of cleaning system can therefore shave off the additives from the image carrier, thereby solving the problems ascribable to filming. However, the bladeless type of cleaning system rubs the image carrier with a weaker force than the blade type of cleaning system, as stated earlier, and therefore cannot sufficiently shave off the film.

Technologies relating to the present invention are also disclosed in, e.g., Japanese Patent Laid-Open Publication Nos. 8-137198, 8-137205, 9-211979, 11-190931, 2000-194242, 2000-242152, 2001-75448, 2001-117317 and 2001-356614.

SUMMARY OF THE INVENTION

It is an object of the present invention to provide an image forming apparatus capable of solving the problems ascribable to filming making the most of the merits of the bladeless type of cleaning system, and a process cartridge for use in the same.

An image forming apparatus of the present invention includes an image carrier, a developing device for developing a latent image formed on the image carrier by depositing toner to thereby form a corresponding toner image, an image transferring device for forming an electric field between the image carrier and a subject body of image transfer to thereby transfer the toner image from the former to the latter, and a cleaning device using a bladeless system for removing residual toner left on the image carrier afterimage transfer without scraping it off with a blade member. A flexible member is affixed at one edge portion and includes a flat surface formed with a plurality of grooves at the other edge portion. The grooves each extend over the image forming range of the surface of the image carrier perpendicularly to a direction in which the above surface is movable. The flexible member is positioned such that the flat surface contacts the surface of the image carrier with the flexible member being deformed.

BRIEF DESCRIPTION OF THE DRAWINGS

The above and other objects, features and advantages of the present invention will become more apparent from the following detailed description taken with the accompanying drawings in which:

FIG. 4 is a table listing the results of experiments conducted to determine the optimum mean circularity of toner;

FIG. 16 is a table listing the results of experiments relating to filming rank.

DESCRIPTION OF THE PREFERRED EMBODIMENTS

Figure 1:
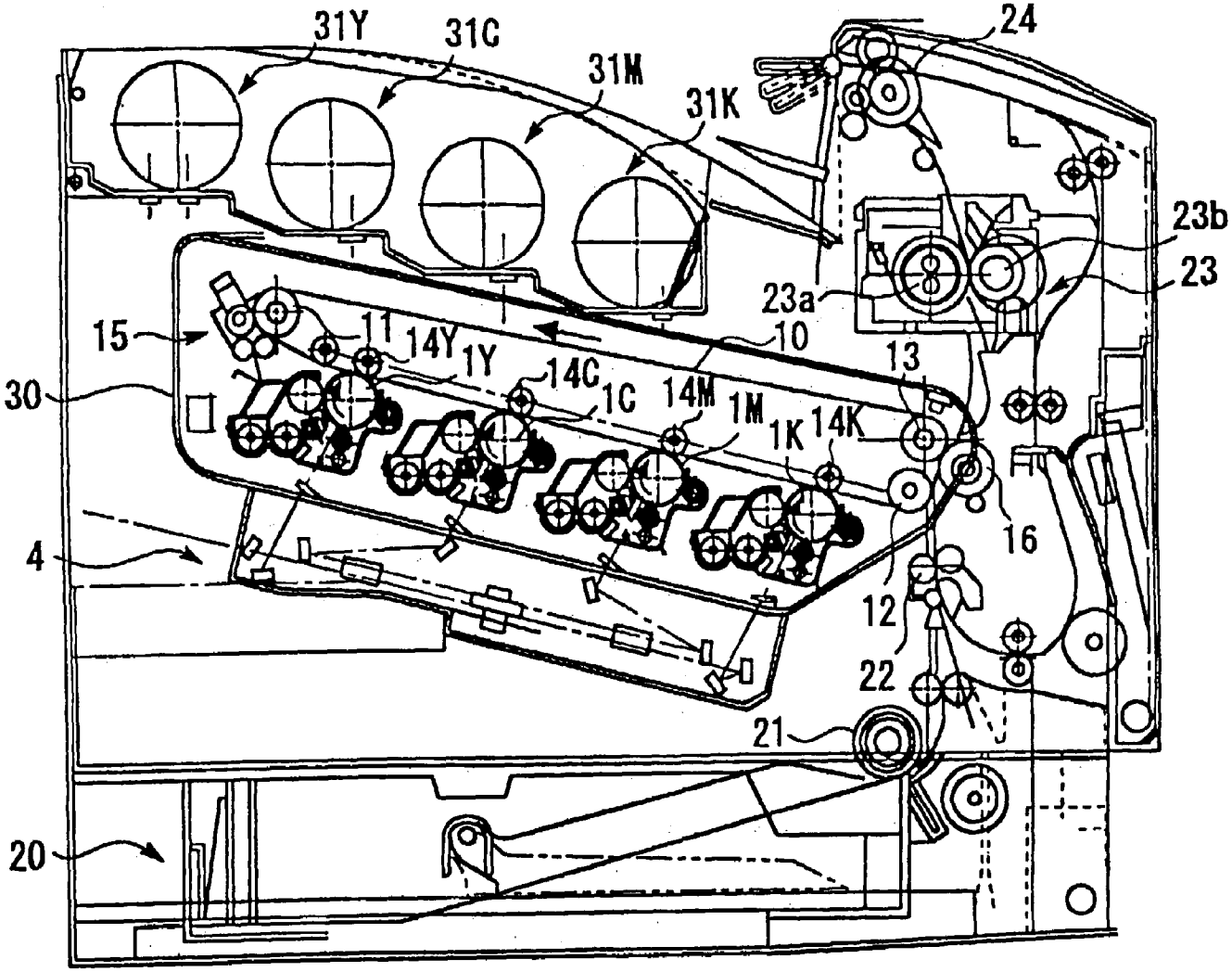
FIG. 1 is a view showing the general construction of a an image forming apparatus embodying the present invention.

Referring to FIG. 1 of the drawings, an image forming apparatus embodying the present invention is shown and implemented as an electrophotographic printer by way of example. The illustrative embodiment forms a color image with Y (yellow), C (cyan), M (magenta) and K (black) toners. As shown, the printer includes four photoconductive drums or image carriers 1Y, 1C, 1M and 1K, which may be replaced with photoconductive belts, if desired. The drums 1Y through 1K rotate in a direction indicated by arrows while contacting an intermediate image transfer belt or movable member (simply belt hereinafter) 10. The drums 1Y through 1K each is made up of a hollow, cylindrical conductive base having relatively small wall thickness, a photoconductive layer formed on the base, and a protection layer formed on the photoconductive layer.

In the illustrative embodiment, the photoconductive layer may be implemented by an OPC (Organic PhotoConductor) in order to reduce cost, enhance free design, and obviate environmental pollution. Polyvinyl carbazole (PVK) or similar photoconductive resin is a typical OPC. Further, OPCs are generally classified into PVK-TNF (2,4,7-trinitrofluorenone) and other charge transfer complex type of OPCs, phthalocyanine binder and other pigment dispersion type of OPCs, split-function type of OPCs each consisting of a charge generating substance and a charge transporting substance. Among them, split-function type of OPCs are attracting increasing attention today.

Figure 2:
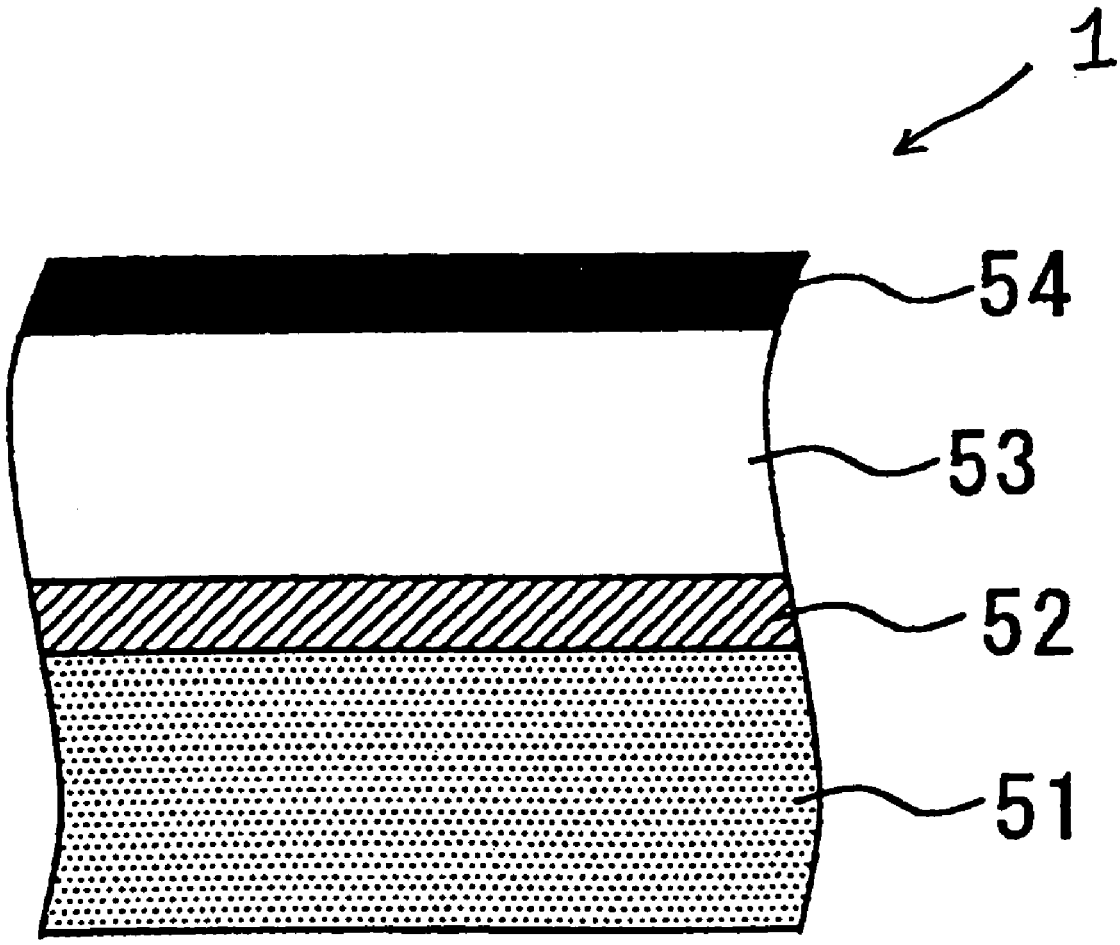
FIG. 2 is a section showing the configuration of a photoconductive drum or image carrier included in the illustrative embodiment.

FIG. 2 is a section showing the structure of any one of the drums 1Y through 1K used in the illustrative embodiment. As shown, the drum, labeled 1, is a split-unction type of photoconductive element and made up of a conductive base 51, a charge generating layer 52 formed on the base 51, a charge transporting layer 53 formed on the charge generating layer 52, and a protection layer 54 for ed on the charge transporting layer 53. A latent image is formed on the drum 1 by the following mechanism.

When the drum 1 is charged and then illuminated by imagewise light, the light propagates through the transparent charge transporting layer 53 and is then absorb d by the charge generating substance of the charge generating layer 52. The charge generating substance then generates charge carriers and injects them in the charge transporting layer 53. The charge carriers migrate through the charge transporting layer 53 to thereby neutralize the charge of the surface of the drum 1. The neutralized portion of the drum 1 becomes a latent image. Such a split-function type of photoconductor should preferably be the combination of a charge transporting substance absorbing mainly ultraviolet rays and a charge transporting substance absorbing mainly visible rays.

Materials applicable to the protection layer 54 include ABS resin, ACS resin, olefine-vinylmonomer copolymer, chlorinated polyether resin, allyl resin, phenol resin, polyacetal resin, polyamide resin, polyamide-imide resin, polyacrylate resin, polyallyl sulfonic resin, polybutylene resin, polybutylene terephthalate resin, polycarbonate resin, polyether sulfonic resin, polyethylene resin, polyethylene terephthalate resin, polyimide resin, acrylic resin, polymethylpentene resin, polypropylene resin, polyphenyleneoxide resin, polysulfonic resin, AS resin, AB resin, BS resin, polyurethane resin, polyvinyl chloride resin, polyvinyliden chloride resin, and epoxy resin.

A filler may be added to the protection layer 54 for improving abrasion resistance. The filler may be any one of polytetrafluoroethylene or similar fluorocarbon resin or silicone resin with or without titanium oxide, tin oxide, potassium titanate, silica, alumina or similar inorganic material being dispersed therein. The content of the filler should be 10 wt. % to 40 wt. %, more preferably 20 wt. % to 30 wt. %. A filler content less than 10 wt. % is apt to make abrasion resistance short, depending on arrangements around the drum 1 relating to the shaving of the drum 1. A filler content higher than 40 wt. % is apt to lower sensitivity to exposure. A dispersion aid may be added for improving the dispersiveness of the filler, if desired. For the dispersion aid, use may be made of any one of dispersion aids customary with, e.g., paints. The amount of the dispersion aid should be 0.5% or above, but 4.0% or below, of the filler content or above in terms of weight, preferably 1% or above, but 2% or below. Addition of a charge transporting material to the protective layer 54 is also effective. An antioxidant may also be added, if necessary.

To form the protection layer 54, any one of conventional methods, including dip coating, spray coating, beat coating, nozzle coating, spinner coating and ring coating, may be used. The thickness of the protection layer is between 0.5 μm and 10 μm, preferably between 4 μm and 6 μm.

An intermediate layer may be formed between the photoconductive layer made up of the charge generating layer 52 and charge transporting layer 53 and the protection layer 54. The intermediate layer consists mainly of binder resin. The binder resin may be any one of polyamide, alcohol-soluble nylon, water-soluble polyvinyl butyral, polyvinyl butyral, polyvinyl alcohol, and so forth. Any one of conventional coating methods may be used to form the intermediate layer. The thickness of the intermediate layer should preferably be between 0.05 μm and 2 μm.

The problem with an OPC, constituting the drum 1, is that it lacks mechanical and chemical durability. More specifically, while many of charge transporting substances are developed as low molecular weight compounds, the compounds each are usually dispersed in or mixed with an inactive polymer because it cannot form a film alone. Generally, a low molecular weight compound or charge transporting substance and a charge transporting layer, which is implemented by an inactive polymer, are soft and lack mechanical durability. Therefore, when the drum 1 with the charge transporting layer is repeatedly used, the layer is easily shaved by the developer, belt 10 and a brush roller 41. It is therefore preferable to form the protection layer 54 in order to extend the life of the drum 1.

Figure 3:
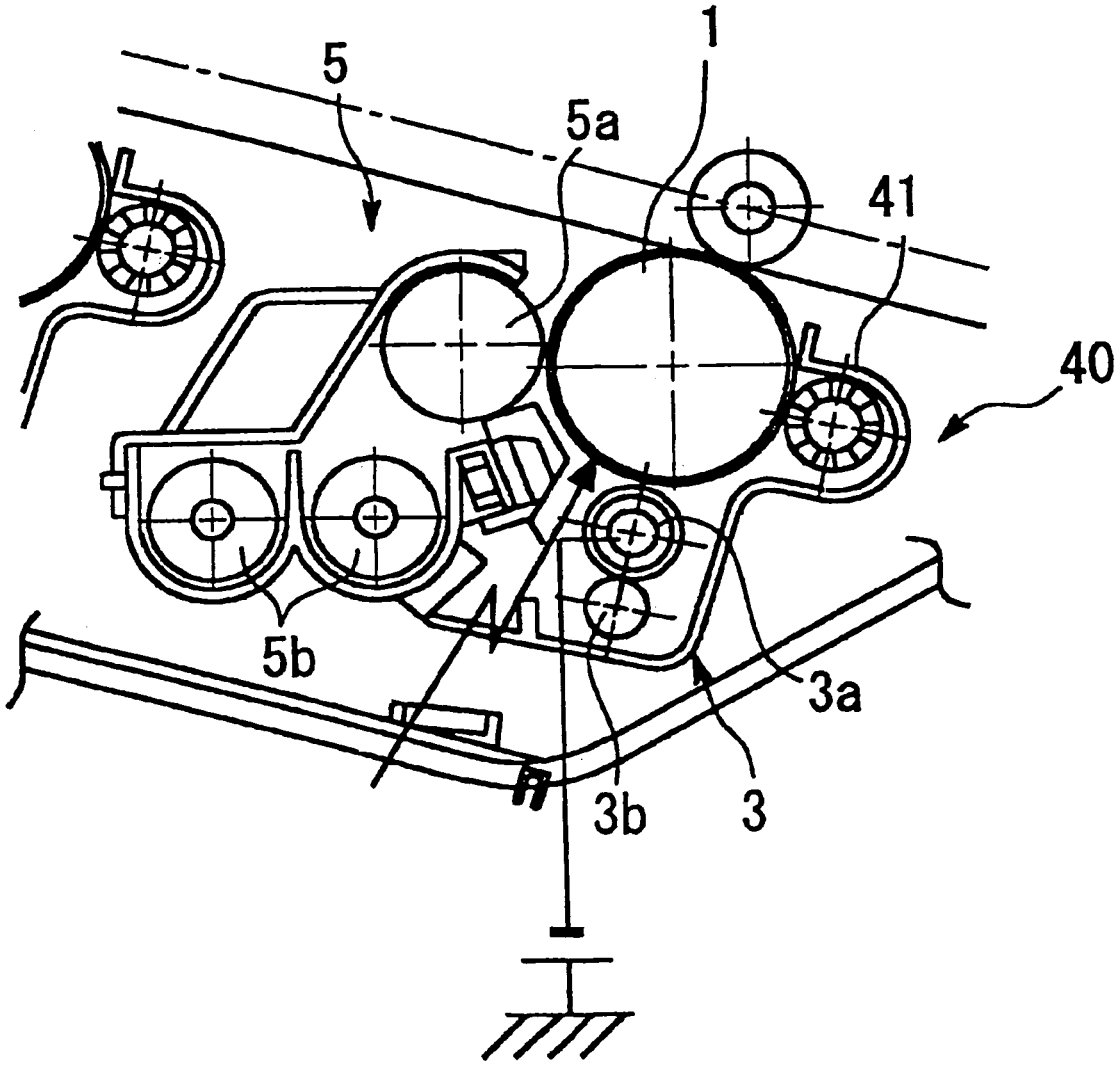
FIG. 3 is a view showing arrangements around the drum.

FIG. 3 shows arrangements around the drum 1. It is to be noted that arrangements around the drums 1Y through 1K are identical with each other and distinguished from each other by suffices Y through K. As shown, a toner holding device or temporary toner holding means 40, a charging device or charging means 3 and a developing device or developing means 5 are sequentially arranged around the drum 1 in this order in the direction in which the surface of the drum 1 moves. A space for allowing a light beam, issuing from the exposing unit or latent image forming means 4 and represented by an arrow, to pass exists between the charging device 3 and the developing device 5.

The charging device 3 uniformly charges the surface of the drum 1 to negative polarity. In the illustrative embodiment, the charging device 3 includes a charge roller or charging member 3*a* that performs contact or vicinity type of charging. More specifically, the charge roller 3*a* contacts or adjoins the surface of the drum 1 and is applied with a negative bias for uniformly charging the drum 1. In the illustrative embodiment, EL DC bias is applied to the drum 1 such that the surface of the drum 1 is uniformly charged to −500 V. The DC bias may be replaced with an AC-biased DC bias, if desired. The AC-biased DC bias, however, needs an exclusive AC power supply and therefore makes the apparatus bulky.

The charging device 3 additionally includes a cleaning brush 3*b* for cleaning the surface of the charge roller 3*a*. In the illustrative embodiment, toner deposits on the charge roller 3*a* little, as will be described later specifically. However, any toner deposited on the charge roller 3*a* would bring about irregular charging or similar defective charging. This is why the cleaning brush 3*b* cleans the surface of the charge roller 3*a*.

If desired, thin films may be wrapped around the axially opposite end portions of the charge roller 3*a* and held in contact with the drum 1. In such a case, the surface of the charge roller 3*a* is extremely close to the surface of the drum 1, but spaced by the thickness of the films. In this condition, the bias applied to the charge roller 3*a* causes discharge to occur between the charge roller 3*a* and the drum 1 for thereby uniformly charging the drum 1.

The exposing unit 4 scans the charged surface of the drum 1 with a light beam in accordance with color-by-color image data, thereby sequentially forming latent images of different colors on the drum 1. While the exposing unit 4 uses a laser in the illustrative embodiment, use may alternatively be made of an exposing unit including an LED (Light Emitting Diode) array and focusing means.

The developing device 5 includes; a casing accommodating a developing roller or developer carrier 5*a*. The developing roller 5*a* is partly exposed to the outside via an opening formed in the casing. The illustrative embodiment uses a two-component type developer made up of toner grains and carrier grains although it is similarly practicable with a single-component type developer, i.e., toner grains. More specifically, the developing device 5 stores toner replenished from corresponding one of toner bottles 31Y through 31K, which are individually removably mounted to the printer body. When any one of the toner bottles 31Y through 31K runs out of toner, it should only be replaced alone, successfully reducing running cost.

The toner replenished from any one of the toner bottles 31Y through 31K to the developing device 5 is conveyed by a screw 5*b* while being agitated together with carrier grains and is then deposited on the developing roller 5*a*. The developing roller 5*a* is made up of a stationary magnet roller or magnetic field generating means and a sleeve rotatable about the axis of the magnet roller. The carrier grains of the developer are caused to rise on the sleeve in the form of brush chains by the magnetic force of the magnet roller and are conveyed by the sleeve to a developing zone where the sleeve and drum 1 face each other. The developing roller 5*a* rotates at a higher linear velocity than the drum 1. The brush chains on the developing roller 5*a* feed the toner grains deposited thereon to the drum 1 while rubbing the surface of the drum 1.

A power supply, not shown, applies a bias of −300 V for development to the developing roller 5*a*, forming an electric field in the developing zone. In this condition, an electrostatic force, directed toward the latent image on the drum 1, acts on the toner grains between the latent image and the developing roller 5*a*, causing the toner grains to deposit on the latent image and develop the latent image. The toner grains of expected or regular polarity, left on the drum 1 after the image transfer, are collected in the developing device 5. In the illustrative embodiment, the developing roller 5*a* is connected to a drive source via a clutch although not shown specifically, so that the roller 5*a* stops rotating when the clutch is uncoupled.

The belt 10 is passed over three rollers 11, 12 and 13 and caused to move in a direction indicated by an arrow in FIG. 1. Toner images of different colors are sequentially, electrostatically transferred from the drums 1Y through 1K to the belt 10 one above the other. While electrostatic image transfer may be implemented by a charger, the illustrative embodiment uses image transfer rollers 14Y through 14K because they reduce toner scattering.

More specifically, the image transfer rollers or primary image transferring means 14Y through 14K are held in contact with the inner surface of the loop of the belt 10 while facing the drums 1Y through 1K, respectively. The portions of the belt 10 pressed by the image transfer rollers 14Y through 14K and drums 1Y through 1K form nips for primary image transfer. A positive bias is applied to each of the image transfer rollers 14Y through 14K when a toner image is to be transferred from associated one of the drums 1Y through 1K tot he belt. 10. As a result, an electric field for image transfer is formed in each nip and electrostatically transfers the toner image from the drum to the belt 10.

A belt cleaner 15 adjoins the belt 10 for removing the toner left on the belt 10 and includes a fur brush and a cleaning blade. The fur brush and cleaning blade collect the toner left on the belt 10 after image transfer. The toner thus collected is conveyed from the belt cleaner 15 to a waste toner tank, not shown, by conveying means not shown.

A secondary image transfer roller 16, is held in contact with part of the belt 10 passed over the roller 13, forming a nip for secondary image transfer therebetween. A sheet or recording medium is fed from a sheet cassette 20 to the above nip by a pickup roller 21 and a roller pair 22 at preselected timing. A composite toner image formed on the belt 10 is transferred from the belt 10 to the sheet at the nip for secondary image transfer. More specifically, a positive bias is applied to the secondary image transfer roller 16, forming an electric field for transferring the toner image from the belt 10 to the sheet.

A fixing unit or fixing means 23 is positioned downstream of the secondary image transfer nip in the direction of sheet conveyance. The fixing unit 23 includes a heat roller 23*a*, which accommodates a heater therein, and a press roller 23*b* pressed against the heat roller 23*a*. The heat roller 23*a* and press roller 23*b* nip the sheet and fix the toner image on the sheet with heat and pressure. The sheet with the toner image thus fixed is driven out to a stack tray positioned on the top of the printer body by an outlet roller pair 24.

In the illustrative embodiment, the drums 1Y through 1K, developing devices and other parts arranged around the drums 1Y through 1K, exposing unit 4, belt 10 and belt cleaning device 15 are constructed into a single process cartridge 30, which is removably mounted to the printer body. The process cartridge 30 can therefore be replaced when the life of any one of constituents thereof ends or the constituent needs maintenance. In the illustrative embodiments, the toner bottles 31Y through 31K each are removable from the printer body independently of the process cartridge 30.

The removal of residual toner grains left on the drums 1Y through 1K will be described hereinafter.

Toner grains used in the illustrative embodiment are produced by polymerization. Such toner grains are close to a true sphere each and have high mean circularity while toner grains produced by conventional pulverization have low mean circularity due to random irregularity existing on the surface of the grains. Generally, tone grains with low mean circularity have a broad grain size distribution and are therefore noticeably irregular in the surface area of the individual grain. Such toner grains are therefore noticeably different from each other in the amount of charge deposited by agitation and frictional charging by a doctor when being conveyed in the form of a developer layer. Consequently, the charge distribution of the toner grains in the developer becomes too broad to be evenly subject to the electric field for image transfer on the drum.

By contrast, the polymerized tone grains with high mean circularity all can be controlled in configuration with high accuracy and have therefore a narrow grain size distribution. Consequently, the difference in the amount of frictional charge between the toner grains and therefore the toner charge distribution decreases. This successfully increases the image transfer ratio for thereby reducing the amount of toner grains to be left on the drum after image transfer.

Toner grains desirably charged deposit on the latent image of the drum 1 with priority and consumed thereby. As a result, the ratio of toner grains not desirably charged to the entire toner grains in the developing device 5 increases. Therefore, in the case of the pulverized toner grains or similar toner grains having low mean circularity and therefore a broad charge distribution, toner grains undesirably charged are left in the developing device 5 in a large amount due to repeated use. Such toner grains fail to accurately deposit on the latent image of the drum 1 although they are subject to the electric field in the developing zone. Therefore, when the mean circularity is low, background contamination, irregularity, in dots and other defects occur due to repeated use, lowering image quality.

Furthermore, the low mean circularity translates into an increase in area over which the toner grains contact the carrier grains, thereby easily causing toner spent to occur. Toner spent, which refers to the filming of toner grains on carrier grains, grows worse with the elapse of time. Toner spent obstructs the frictional charging of fresh toner grains replenished to the developing device 5 and is also considered to degrade image quality.

By contrast, the toner grains with high mean circularity and therefore narrow charge distribution applied to the illustrative embodiment contain a far smaller amount of toner grains of undesirable charge than the toner grains with low mean circularity. Such toner grains therefore cause a minimum of background contamination, irregularity in dots and other defects despite a long time of use. Further, the high mean circularity reduces the area over which the toner grains contact carrier grains for thereby preventing toner spend from easily occurring, so that high image quality is insured over a long period of time.

The adequate value of mean circularity was determined by the following experiments. A developing device storing a developer was idled to determine a period of time in which toner spent was observed. FIG. 4 lists the results of experiments. When the mean circularity was 0.93 or above, toner spent was not observed at all even in 4,200 minutes corresponding to a period of time necessary for outputting 150,000 prints, which is generally used as a reference number of prints for estimation. The illustrative embodiment therefore uses toner grains having mean circularity of 0.93 or above.

The mean circularity was determined by the following procedure using a flow type grain image analyzer FPIA-2100 (trade name) available from SYSMEX CORPORATION. First, a 1% NaCl aqueous solution is prepared by using primary sodium chloride. The NaCl aqueous solution is then passed through a 0.45 filter in order to produce 50 ml to 100 ml of liquid. Subsequently, 0.1 ml to 5 ml of surfactant, preferably alkylbenzene solfonate, is added to the above liquid, and then 1 mg to 10 mg of sample is added. The resulting mixture is dispersed for 1 minute in an ultrasonic dispersing device to thereby regulate the grain density to 5,000 grains/μ1 15,000 grains/μ1. The liquid thus dispersed is picked up by a CCD (Charge Coupled Device) camera. Thereafter, the circumferential length of a circle identical in area with the area of the bidimensional projection image of the toner grain is divided by the circumferential length of the projection image of the toner grain, thereby producing circularity of the individual toner grain. Considering the accuracy of the CCDs or pixels, it was determined that a toner grain was acceptable if the diameter of the circle identical in area with the bidimensional projection image of the toner grain was 0.6 μm or above. Finally, the circularities of the acceptable toner grains are added and then divided by the number of toner grains to thereby produce mean circularity.

The toner applicable to the illustrative embodiment may be produced by suspension polymerization that mixes a monomer, a starter, a colorant and so forth and then polymerizes, washes, dries and then executes postprocessing with the mixture. Suspension polymerization may be replaced with emulsion polymerization, bulk polymerization or solution polymerization, if desired.

Figure 5A:
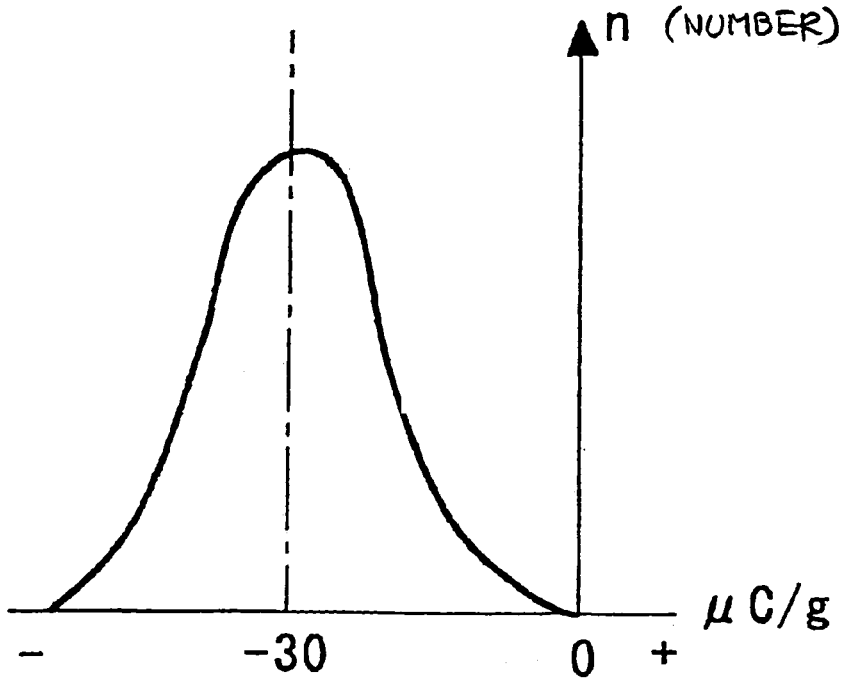
FIG. 5A is a graph showing the charge potential distribution of toner present the drum just before image transfer.
Figure 5B:
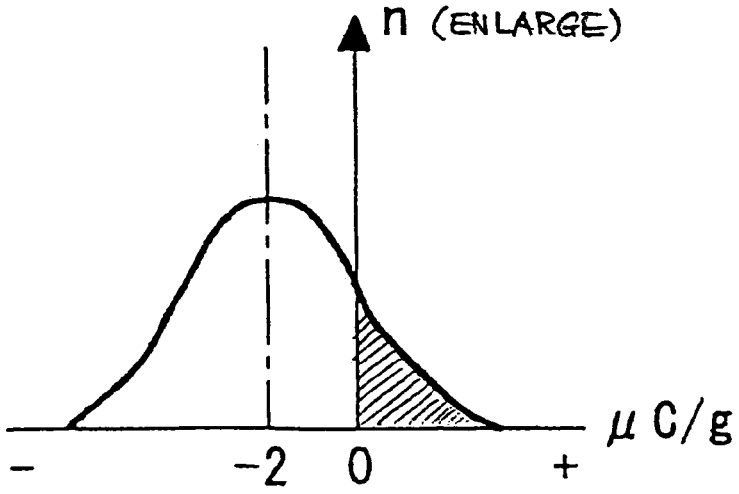
FIG. 5B is a graph showing the charge potential distribution of the toner after the transfer.

FIG. 5A is a graph showing the charge potential distribution of the toner grains just before the transfer from the drum 1. FIG. 5B is a graph showing the charge potential distribution of the toner grains left on the drum 1 after the transfer from the drum 1. As shown in FIG. 5A, the amount of charge just before the transfer is distributed at both sides of substantially −30 μC/g; most of the toner grains are charged to negative or regular polarity. As shown in FIG. 4B, the amount of charge left on the drum 1 after the transfer is distributed at both sides of substantially −2 μC/g. Generally, most of the toner grains left on the drum 1 after the transfer are defective grains unable to be charged to the expected polarity due to, e.g., defective composition. Therefore, part of the residual toner grains is charged to positive polarity due to, e.g., charge injection ascribable to the positive bias applied to the primary image transfer roller 14. This is why toner grains of opposite polarity exist, as indicated by a hatched portion in FIG. 5B.

If the toner grains of opposite polarity are conveyed by the drum 1 to the position where the drum 1 faces the charge roller 3*a*, which is applied with the positive bias, then they are electrostatically attracted by and deposited on the charge roller 3*a*. This is also true with the configuration in which the charge roller 3*a* adjoins the drum 1 as stated above. The toner grains so deposited on the charge roller 3*a* cause the resistance and surface condition of the charge roller 3*a* to vary, so that charge start voltage between the charge roller 3*a* and the drum 1 becomes irregular. As a result, even if the same bias as when the toner grains of opposite polarity are absent on the charge roller 3*a* is applied, the drum 1 cannot be uniformly charged to the desired potential of −500 V. This is apt to bring about irregular image density as well.

Further, when the toner grains deposit on only part of the charge roller 3*a*, the current derived from the charge bias concentrates on the other part of the charge roller 3*a* where such toner grains are absent. Therefore, if the same bias as when the toner grains of opposite polarity are absent is applied, then the charge potential of the drum 1 rises above the desired potential. Consequently, the potential of the latent image portion, which is formed by the exposing unit 4, is shifted to the negative side, lowering image density.

Moreover, when the toner grains deposit on substantially the entire charge roller 3*a* in such a manner as to coat the charge roller 3*a*, the charging ability of the charge roller 3*a* is lowered with the result that the surface potential of the drum 1 is lowered below the desired potential. Consequently, the potential of the portion of the drum 1 not scanned by the exposing unit 4, i.e., the background portion approaches the bias applied to the developing roller 5*a*. This causes toner grains with short charge to deposit on the background of the drum, thereby bringing about background contamination.

On the other hand, the residual toner grains on the drum 1 contain toner grains of negative or regular polarity as well. Such negative toner grains, however, do not deposit on the charge roller 3*a* even when conveyed to the position where the charge roller 3*a* and drum 1 face each other so long as the bias is applied to the charge roller 3*a*. Moreover, such toner grains have little influence on the image forming step, as stated previously. It is therefore important to prevent the toner grains of opposite polarity, existing in the residual toner grains, from adversely effecting the image forming step.

In light of the above, the illustrative embodiment removes, before the residual toner on the drum 1 reaches the position where the drum 1 and charge roller 3*a* face each other, the toner of negative polarity with the temporary holding means.

The removal of the toner of opposite polarity from the drum 1, which characterizes the illustrative embodiment, will be described specifically hereinafter. First, reference will be made to FIG. 6 for describing the configuration and operation of the toner holding device or temporary toner holding means 40. As shown, the toner holding device 40 includes a brush roller or toner dispersing member 41 held in contact with the drum 1. The brush roller 41 is provided with relatively low brush density so as to have a space large enough to accommodate toner grains of opposite polarity $T_1$. This not only reduces the frequency of release of the toner grains $T_1$, which will be described later, but also reduces mechanical restraint to act on the toner grains $T_1$ held by the brush roller 41 for thereby promoting smooth release of the toner grains $T_1$, as will be described later specifically. In the illustrative embodiment, density around the surface of the brush roller 41 is selected to be between 12,000 bristles/inch$^2$ and 858,000 bristles/inch$^2$.

Figure 6:
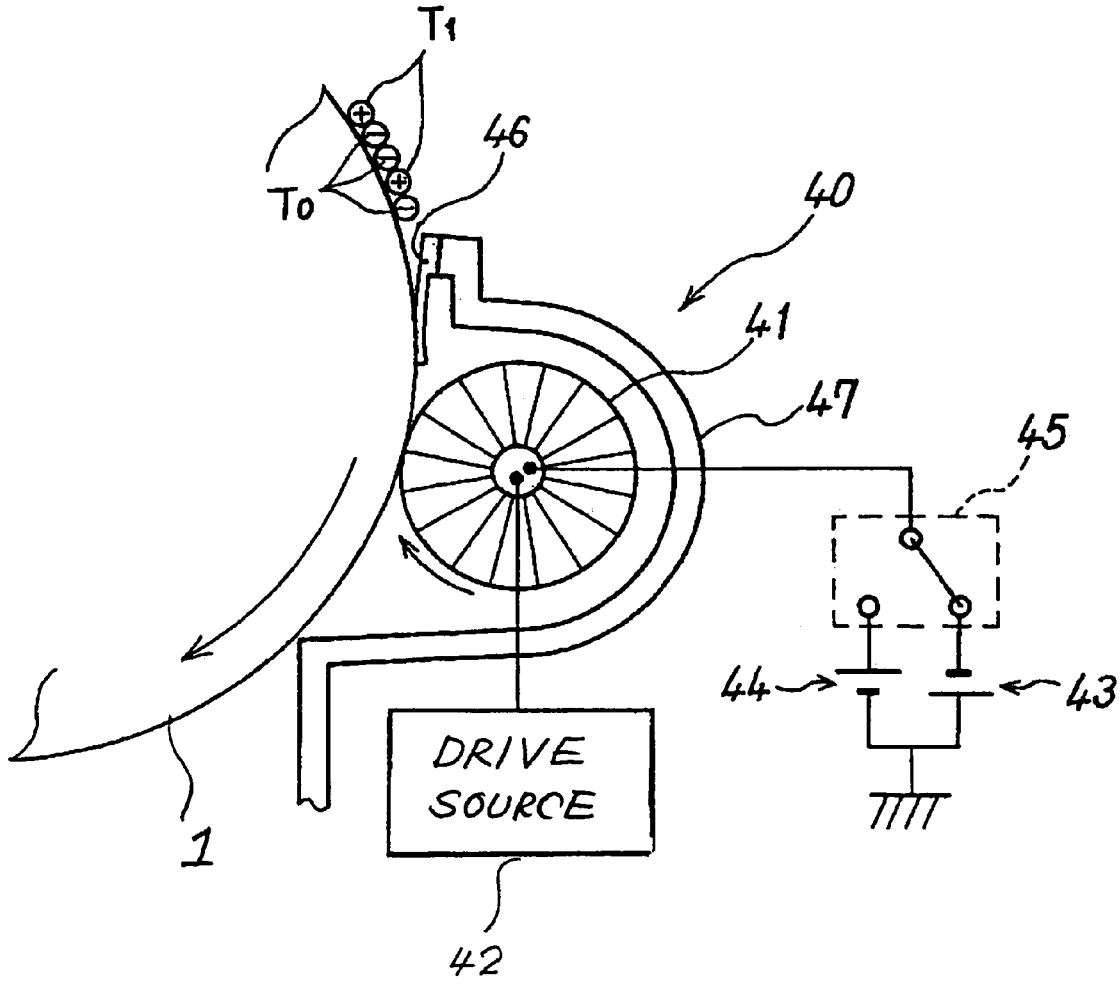
FIG. 6 is a view showing a toner holding device included in the illustrative embodiment.

A drive source 42 causes the brush roller 41 to rotate in a direction indicated by an arrow in FIG. 6. A first and a second power supply 43 and 44 selectively apply a bias to the brush roller 41 via a switch 45. The switch 45 is controlled by a controller, not shown, included in the illustrative embodiment. The first and second power supplies 43 and 44 respectively apply a hold bias that deposits a potential of −700 V on the brush roller 41 and a release bias that deposits a potential of +200 V on the same. The hold bias causes the brush roller 41 to hold the toner grains of opposite polarity $T_1$ while the release bias causes the former to release the latter. While the power supplies 43 and 44 are implemented as DC power supplies in the illustrative embodiment, they may alternatively be implemented as AC-biased DC power supplies, if desired.

Before part of the drum 1 where the residual toner grains are deposited reaches a zone where the drum 1 and brush roller 41 contact each other (brush contact zone hereinafter), the first power supply 43 starts applying the hold bias to the brush roller 41 via the switch 45. In this condition, on contacting the drum 1, the brush roller 41 causes the toner grains of opposite polarity $T_1$ to deposit on the brush roller 41 for thereby holding them.

More specifically, the drum 1, uniformly charged to −500 V by the charging device 3, is scanned by the exposing unit 4 with the result that the potential of the latent image portion is varied to about −50 V. After the developing step and image transferring step following the above scanning step, the potential of the latent image portion is brought closer to 0 V. Most of the residual toner grains on the drum 1 are present in the portion where the latent image was present. Therefore, in the brush contact zone, the toner grains $T_1$ present on such a portion of the drum 1 are subject to an electrostatic force extending toward the brush roller 41, which is applied with the bias of −700 V. The background portion of the drum 1 where the potential is −500 V is also subject to the image transferring step, so that the potential is shifted toward the 0 V side. While a small amount of residual toner sometimes deposits on the background portion, the above electrostatic force acts on such toner grains $T_1$ also. Consequently, the toner grains $T_1$, included in the residual toner grains on the drum 1, are deposited on and held by the brush roller 41 in the brush contact zone.

On the other hand, the toner grains of negative or regular polarity $T_0$, also included in the residual toner grains on the drum 1, are subject to an electrostatic force extending toward the drum 1 in the brush contact zone. The toner grains $T_0$ therefore remain on the drum 1 without being transferred to the brush roller 41. The toner grains $T_0$, conveyed via the brush contact zone by the drum 1, do not adversely effect the image transferring step, as stated earlier, but simply form the next toner image or are collected by the developing device 5.

In the illustrative embodiment, the brush roller 41 is rotated in the opposite direction to the drum 1, i.e., in the counter direction in the brush contact region, so that a number of bristles can rub the surface of the drum 1 with their tips. In the illustrative embodiment, the brush roller 41 rubs the surface of the drum 1 to thereby disperse the toner grains $T_0$ of regular polarity present on the drum 1. This successfully weakens the adhesion of the toner grains $T_0$ to the drum 1 and therefore promotes easy collection of the toner grains $T_0$ moved away from the brush contact zone by the developing device 5.

The above advantage is achievable even when the brush roller 41 is moved in the same direction as the drum 1 in the brush contact zone if a linear velocity difference is established therebetween. Further, such movement of the brush roller 41 reduces load torque to act on the drive sources assigned to the brush roller 41 and drum 1, compared to the counter movement of the brush roller 41 stated above. In addition, a decrease in the load torque to act on the drive source assigned to the drum 1 reduces banding for thereby insuring stable, high quality images.

In the illustrative embodiment, a cleaning blade contacting the drum 1 is absent. This further reduces the load torque to act on the drive source assigned to the drum 1. However, the absence of a cleaning blade degrades the ability to remove the residual toner from the drum 1, so that additives contained in the toner are apt to firmly adhere to the drum 1 in the form of a film (so-called filming). Although the spherical toner used in the illustrative embodiment remains on the drum 1 little, as stated earlier, filming is likely to occur after a long time of operation. To solve this problem, the brush roller 41 is rotated in the counter direction, as stated earlier. This obviates filming by allowing the developing device 5 to efficiently collect the toner grains $T_0$, as stated previously.

Hereinafter will be described how the brush roller 41 is caused to release the toner grains $T_1$ to the surface of the drum 1. In the illustrative embodiment, the brush roller 41, holding the toner grains of opposite polarity $T_1$, releases or returns them to the surface of the drum 1 when image formation is not under way, i.e., during the interval between consecutive image formation. More specifically, after holding all the toner grains $T_1$ derived from one image forming step, the brush roller 41 releases them before part of the drum 1 to be uniformly charged by the charging device 3 during the next image forming step arrives at the brush contact zone. This allows the toner grains $T_1$ to be collected by the developing device 5 without adversely effecting the next image forming step. It is to be noted that in a repeat print mode, the brush roller 41 may release the toner grains $T_1$ consecutively deposited thereon after the last image forming step, in which case the image forming time is prevented from extending due to the collection of the toner grains $T_1$ to be described later.

The release of the toner grains $T_1$ will be described more specifically hereinafter. The potential left after the preceding image forming step exists on part of the surface of the drum 1 to which the toner grains $T_1$ are expected to deposit at the timing stated above. In the illustrative embodiment, the residual potential is about −50 V. When the second power supply 44 applies the release bias to the brush roller 41 via the switch 45, the potential of +200 V is deposited on the brush roller 41 with the result that an electrostatic force, directed toward the drum 1 whose surface potential is −50 V, acts on the toner grains $T_1$. Consequently, the toner grains $T_1$ are released from the brush roller 41 and deposited on the drum 1.

The collection of the toner grains $T_1$ again transferred from the brush roller 41 to the drum 1 will be described hereinafter. In the illustrative embodiment, before the toner grains $T_1$ again deposited on the drum 1 reach a position where they contact the charge roller 3*a*, the application of the bias to the charge roller 3*a* is interrupted by the controller. In this sense, the controller plays the role of bias interrupting means. As a result, the charge roller 3*a* is grounded with the result that the surface potential of the charge roller 3*a* becomes substantially 0 V. On the other hand, because the surface potential of the drum 1 on which the toner grains $T_1$ are present is about −50 V, as stated previously, an electrostatic force, directed toward the drum 1, acts on the toner grains $T_1$ at the contact position of the drum 1 and charge roller 3*a*. Consequently, the toner grains $T_1$ can pass the contact position without depositing on the charge roller 3*a*.

The toner grains $T_1$ moved away from the position where they contact the charge roller 3*a* are conveyed to the developing zone. The illustrative embodiment uncouples the clutch associated with the developing roller 5*a* before the toner grains $T_1$ on the drum 1 arrive at the developing zone, thereby preventing the toner in the developing device 5 from depositing on the drum 1 and being wastefully consumed thereby. Further, before the toner grains $T_1$ arrive at the developing zone, a bias identical with the bias for development, i.e., −300 V is applied to the developing roller 5*a*, which plays the role of collecting means. As a result, an electrostatic force, directed toward the developing roller 5*a*, acts on the toner grains $T_1$ and causes them to deposit on the developing roller 5*a*. Subsequently, the clutch is again coupled to rotate the developing roller 5*a* at the time of the next image formation, so that the developing roller 5*a* conveys the toner grains $T_1$ into the developing device 5. The toner grains $t_1$ are then conveyed in the developing device while being charged to the expected polarity, again contributing to development.

As stated above, in the illustrative embodiment, the brush roller 41 temporarily holds the toner grains $T_1$ of opposite polarity included in the residual toner grains left on the drum 1, thereby preventing the toner grains $T_1$ from depositing on the charge roller 3*a*. This prevents the charge start voltage between the charge roller 3*a* and the drum 1 from varying for thereby obviating short image density, background contamination and irregular image density.

Further, in the illustrative embodiment, the toner grains $T_1$ released from the brush roller 41 are collected by the developing device 5 and can therefore be recycled. This makes it needless to provide a waste toner tank for storing the toner grains $T_1$ for thereby implementing size reduction. Particularly, because the illustrative embodiment is a tandem printer including four drums 1Y through 1K, the size reduction is noticeable, compared to the conventional printer in which a particular waste toner tank is assigned to each drum.

With the configuration described so far and not using a cleaning blade, it is impossible to fully obviate filming conventionally controlled by a cleaning blade. In light of this, as shown in FIG. 6, the illustrative embodiment additionally includes a MYLAR (polyester) sheet or flexible member 46 forming part of the toner holding device 40. The MYLAR sheet 46 is affixed to the upstream end of a casing 47 in the direction of movement of the drum surface such that a flat surface included in the end portion of the MYLAR sheet 46 contacts the surface of the drum 1.

Figure 7:
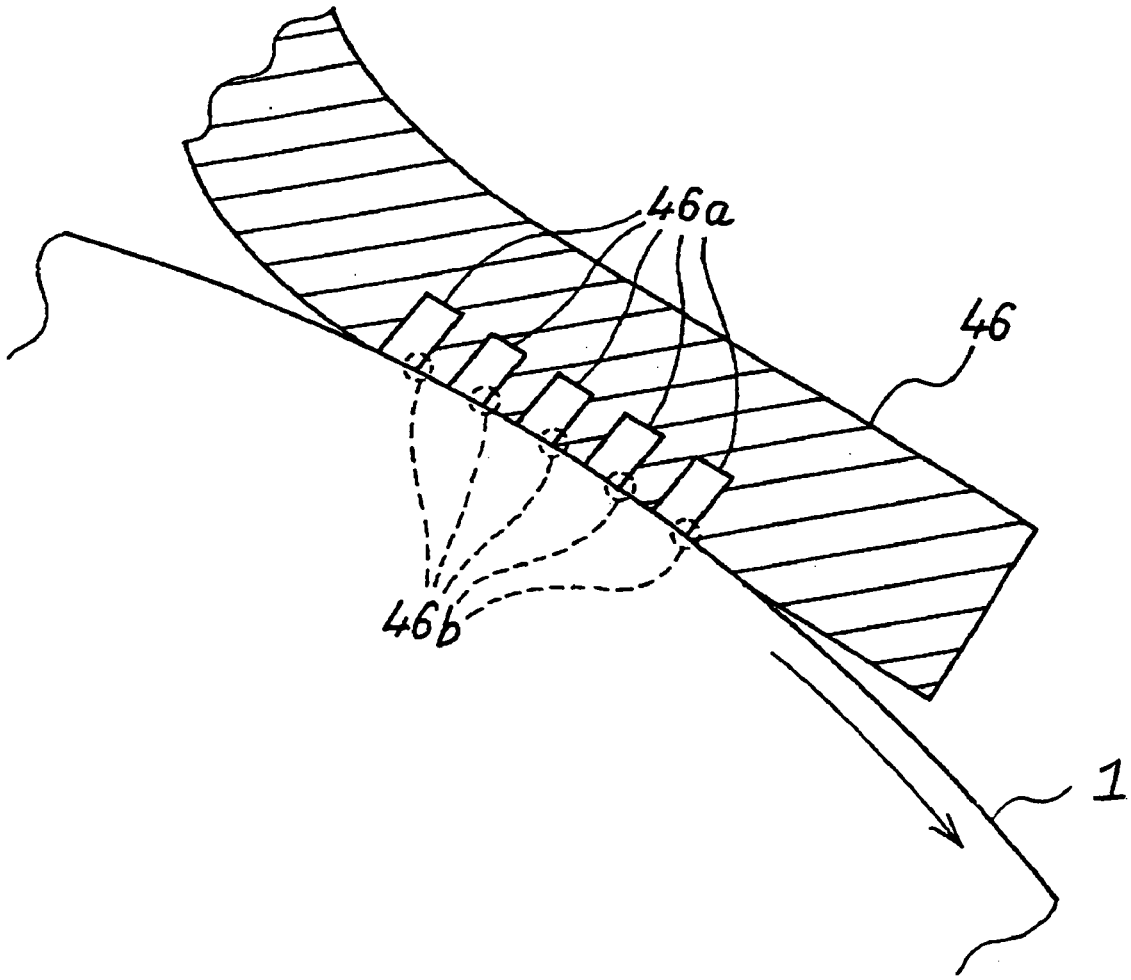
FIG. 7 is an enlarged view showing how a MYLAR sheet included in the illustrative embodiment is held in contact with the drum.

As shown in FIG. 7, the flat surface of the MYLAR sheet 46 mentioned above is formed with a plurality of (five in the illustrative embodiment) elongate grooves 46*a* each extending perpendicularly to the direction of movement of the drum surface. With this configuration, the MYLAR sheet 46 shaves the surface of the drum 5 with the downstream edges 46*b* of the grooves 46 in the direction of movement of the drum surface a plurality of times. The MYLAR sheet 46 can therefore shave off additives deposited on the drum 1 in the form of a film by contacting the drum 1 with lower pressure than a cleaning blade.

When use is made of highly circular, spherical toner grains as in the illustrative embodiment, even a cleaning blade cannot fully remove residual toner grains because such toner grains pass the position where the cleaning blade and drum 1 contact each other. This is also true with the MYLAR sheet 46. In this sense, the MYLAR sheet 46 plays the role of means for removing additives forming a film on the drum 1 rather than cleaning means for removing residual toner grains while the toner holding device 40 and developing device 5 play the role of cleaning means.

To shave off additives forming a film on the drum 1, the MYLAR sheet 46 must contact the drum 1 with some pressure. For this purpose, in the illustrative embodiment, the MYLAR sheet 46 is implemented as a sheet member having a suitable degree of elasticity and formed of polyethylene terephthalate (PET). The MYLAR sheet 46 is affixed to the casing 47 and belt such that its flat surface is pressed against the drum 1.

Figure 8:
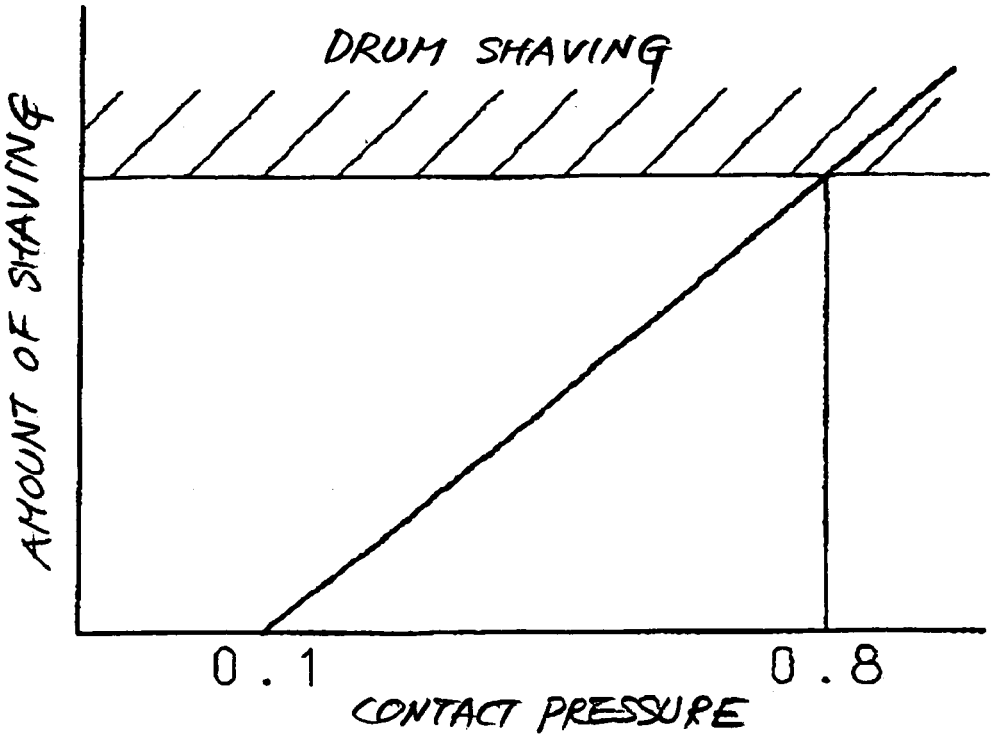
FIG. 8 is a table listing the results of experiments conducted to determine the optimum pressure with which the MYLAR sheet contacts the drum.

The contact pressure of the MYLAR sheet 46, contacting the drum 1, should preferably be between 0.1 N and 0.8 N, as determined by experiments. FIG. 8 shows the results of experiments conducted to determine the contact pressure. As shown, contact pressure lower than 0.1 N was too low to sufficiently shave off additives forming a film on the drum 1 while contact pressure higher than 0.8 N noticeably scratched the drum 1.

Figure 9:
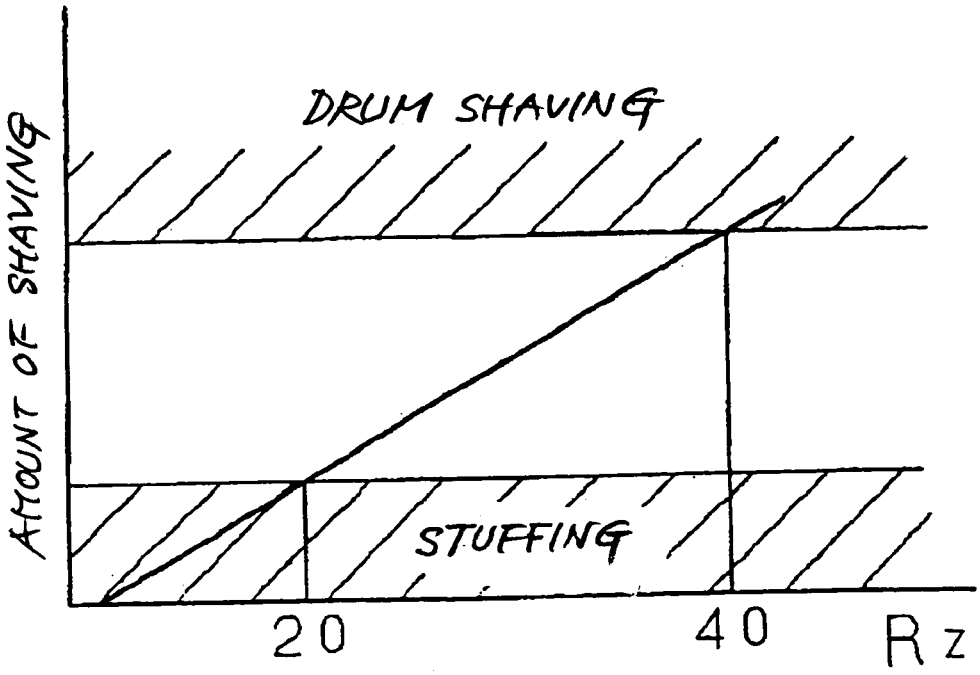
FIG. 9 is a table listing the results of experiments conducted to determine the optimum surface roughness Rz of the contact surface of the MYLAR sheet contacts the drum.

It was experimentally found that the grooves 46*a* of the MYLAR sheet 46 should preferably have surface roughness Rz of 20 or above, but 40 or below. More specifically, as shown in FIG. 9, surface roughness Rz below 20 caused an excessive amount of toner to fill up the grooves 46*a* for thereby degrading the shaving effect in a short period of time. Also, surface roughness Rz above 40 sometimes caused the grooves 46*a* to noticeably scratch the drum 1.

Figure 10:
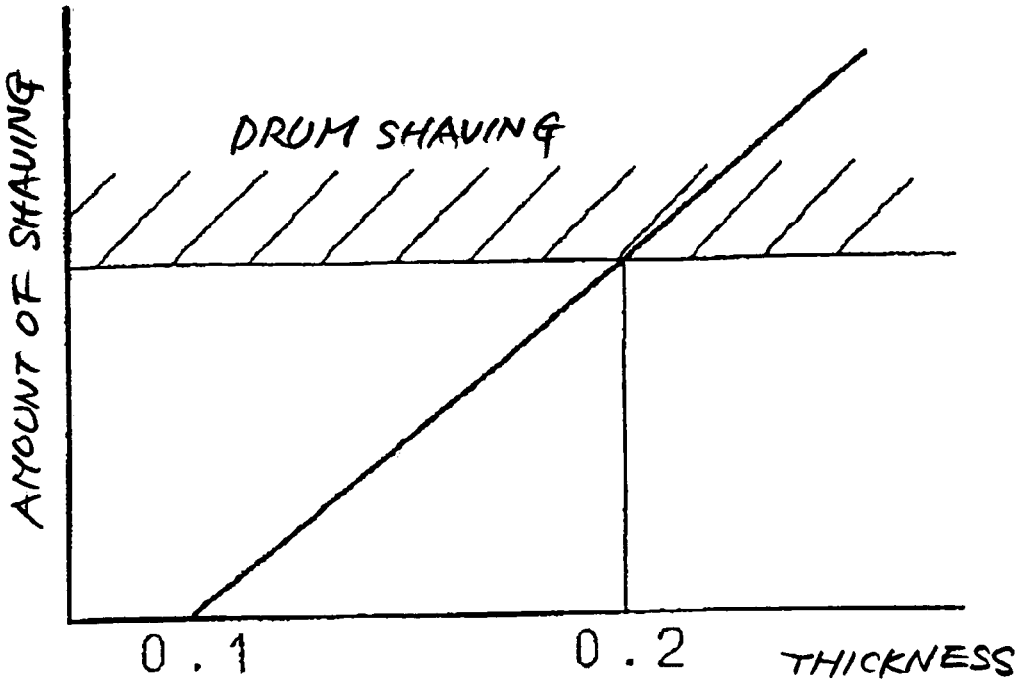
FIG. 10 is a table listing the results of experiments conducted to determine the optimum thickness of the MYLAR sheet.

Further, experiments showed that the thickness of the MYLAR sheet 46 should preferably be between 0.1 mm and 0.2 mm. More specifically, as shown in FIG. 10, thickness below 0.1 mm made the elasticity of the PET sheet too short to implement the contact pressure stated above while thickness above 0.2 mm made the above elasticity too high to implement the desired contact pressure and noticeably scratched the drum 1.

Figure 11:
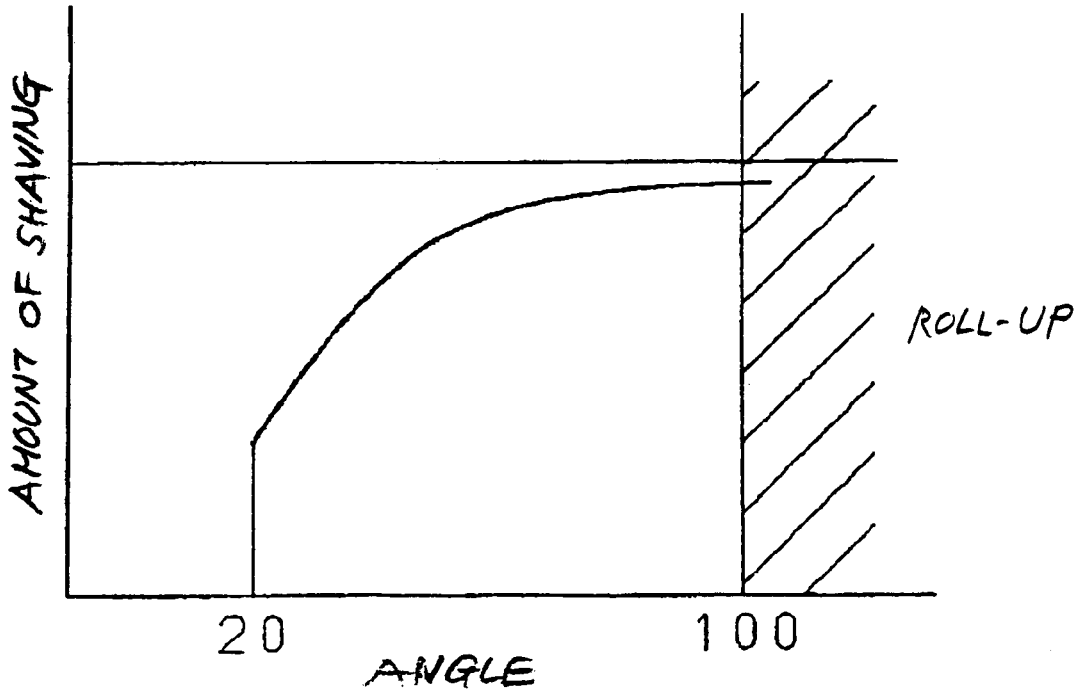
FIG. 11 is a table listing the results of experiments conducted to determine the optimum contact angle of the MYLAR sheet with the drum.

Moreover, the MYLAR sheet 46 should preferably contact the drum 1 at an angle of between 20° and 100°. This contact angle refers to one between the flat portion of the MYLAR sheet 46 in the absence of the drum 1 and a line tangential to the drum 1 and intersecting the flat portion. More specifically, as shown in FIG. 11, a contact angle below 20° made it difficult to implement the desired contact pressure and prevented the MYLAR sheet 46 from sufficiently shaving off additives from the drum 1. Also, a contact angle above 100° sometimes caused the drum 1 to roll up the MYLAR sheet 46.

As stated above, the toner holding device 40 and developing device 5 constitute bladeless type of cleaning means not using a cleaning blade. This, coupled with the MYLAR sheet 46 formed with the grooves 46*a*, achieves the advantages of the bladeless type of cleaning means, i.e., the extension of the life of the drum 1 and the reduction of drum drive load.

When the toner grains exist on the drum 1 in a large amount when image formation is interrupted due to, e.g., a jam, the illustrative embodiment, lacking a cleaning blade for the drum 1, cannot easily collect the toner grains from the drum 1. In the illustrative embodiment, after a jam, for example, has been settled, the toner grains are transferred to the belt 10 in the same manner as during usual image formation and then collected by the belt cleaner 15. The belt cleaner 15 can collect even a large amount of toner grains because it includes the fur brush and cleaning blade. Part of the toner grains, which may be left on the drum 1 even after the transfer to the belt 10, are dealt with in the same manner as during usual image formation.

While the illustrative embodiment causes the developing device 5 to collect the toner grains $T_1$ of opposite polarity released from the brush roller 41, any other collecting method may be used. For example, an arrangement may be made such that the toner grains $T_1$, released from the brush roller 41, are transferred to the belt 10 and then collected by the belt cleaner 15 or further transferred to the secondary image transfer roller 16, in which case cleaning means will be assigned to the roller 16.

If desired, the above alternative arrangement may be used in combination with the developing device 5, so that the toner grains $T_1$ that the developing device 5 failed to collect can be collected by the belt 10 at the secondary image transfer nip. This two-stage collection enhances the toner collecting ability and therefore insures toner collection. Consequently, even a large amount of toner grains $T_1$, which may be released from the brush roller 41 at a time, can be sufficiently collected, so that the frequency of release of toner from the brush roller 41 can be reduced.

While the foregoing description has concentrated on a simultaneous development and bladeless cleaning system, the illustrative embodiment is similarly applicable to an image forming apparatus of the type removing residual toner with a brush roller or a bias applying member configured to electrostatically collect residual toner.

As stated above, the illustrative embodiment is capable of shaving off additives forming a film on the drum 1 with lower pressure than a system using a cleaning blade. It is therefore possible to sufficiently control filming while making the most of the bladeless cleaning system.

An alternative embodiment of the present invention will be described hereinafter. FIGS. 1 through 6 and description relating thereto directly apply to the alternative embodiment as well, so that the following description will concentrate on features characterizing the alternative embodiment.

In the illustrative embodiment, the bristles of the brush roller 41 are 3 mm long, as measured from the shaft of the brush roller 41, and provided with a Young's modulus of 30 cN/dtex. Also, the contact pressure between the drum 1 and the brush roller 41 is selected to be 40 g/cm$^2$ or above. In this condition, filming ascribable to silica, parted from the toner, can be sufficiently reduced, as will be described more specifically later in relation to Experiment 1. It is therefore possible to desirably cope with blurring and other image defects ascribable to filming.

The tips of the bristles, constituting the brush roller 41, jump up when they part from the surface of the drum 1 and are therefor likely to scatter the toner grains. If the brush roller 41 is moved in the same direction as the drum 1 in the brush contact zone, then the toner grains so scattered fly toward the downstream side of the brush contact zone in the direction of movement of the drum 1. Should such toner grains be of opposite polarity, then they would deposit on the charge roller 3*a* and bring about defective charging. By contrast, when the brush roller 41 is moved in the counter direction as in the illustrative embodiment, the toner grains scattered fly toward the upstream side of the brush contact zone in the direction of movement of the drum 1 and do not deposit on the charge roller 3*a*.

A first modification of the illustrative embodiment will be described hereinafter. The first modification differs from the illustrative embodiment in that it causes the belt cleaner 15 to collect the toner grains T1 released from the brush roller 41. As for the rest of the configuration, the first modification is identical with the illustrative embodiment.

Figure 12:
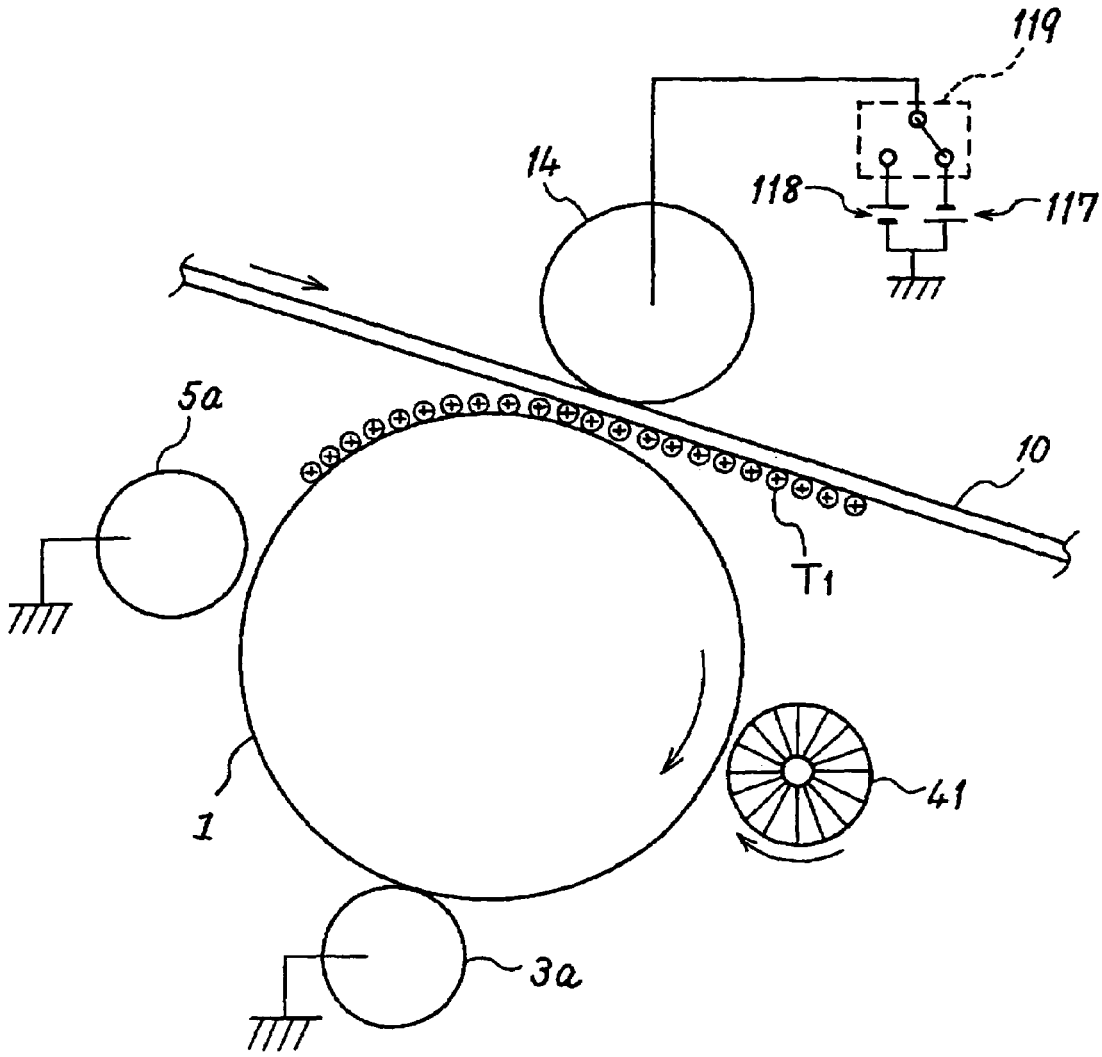
FIG. 12 shows arrangements around a primary image transfer nip relating to the collection of toner grains of opposite polarity and unique to a first modification of an alternative embodiment of the present: invention.

FIG. 12 shows arrangements around the primary image transfer nip included in the first modification. The first modification, like the illustrative embodiment, interrupts the application of the bias to the charge roller 3*a* before the toner grains $T_1$ on the drum 1 arrive at the contact zone where the drum 1 and charge roller 3*a* contact each other. The toner grains $T_1$ can therefore pass the contact zone without depositing on the charge roller 3*a*. Further, the first modification interrupts the application of the bias to the developing roller 5*a* as well before the toner grains $T_1$ on the drum 1 reach the developing zone. As a result, the developing roller 5*a* is grounded with the result that the surface potential of the developing roller 5*a* becomes substantially 0 V. On the other hand, because the surface potential of the drum 1 on which the toner grains $T_1$ are present is about −50 V, as stated previously, an electrostatic force, directed toward the drum 1, acts on the toner grains $T_1$ in the developing zone. Consequently, the toner grains $T_1$ can pass the developing zone without depositing on the developing roller 5*a*.

As shown in FIG. 12, the toner grains $T_1$ moved away from the developing zone are conveyed to the primary image transfer nip where they contact the belt 10. The illustrative embodiment applies a bias opposite in polarity to the bias for image formation to the primary image transfer roller 14 before the toner grains $T_1$ on the drum 1 arrive at the primary image transfer nip. More specifically, as shown in FIG. 12, a first and a second image transfer power supply 117 and 118 selectively apply a bias to the primary image transfer roller 14 via a switch 119 under the control of the controller.

The first power supply 117 applies a bias of −300 V while the second power supply 118 applies a bias that differs from one of the primary image transfer rollers 14Y through 14K to another and lies in the range of from +400 V to +2,000 V. The second power supply 118 is connected to the primary image transfer roller 14 in the event of image transfer while the first power supply 118 is connected to the same in the event of collection of the toner grains $T_1$ from the drum 1.

The negative bias, applied to the primary image transfer roller 14 in the event of collection, forms an electric field between the surface of the drum 1 (−50 V) on which the toner grains $T_1$ are present and the belt 10. The electric field causes an electrostatic force directed toward the belt 10 to act on the tone grains $T_1$, thereby transferring the toner grains $T_1$ from the drum 1 to the belt 10. Subsequently, the toner grains on the belt 10 are conveyed to the secondary image transfer nip between the belt 10 and the secondary image transfer roller 16. Before the toner grains $T_1$ arrive at the above nip, the bias for image transfer for usual image transfer, i.e., a positive bias is applied to the secondary image transfer roller 16. Because the surface potential of the belt 10, carrying the toner grains $T_1$, is substantially 0 V at the nip, an electrostatic force, directed toward the belt 10, acts on the toner grains $T_1$ at the nip. Consequently, the toner grains $T_1$ are allowed to pass the nip without depositing on the secondary image transfer roller 16.

Alternatively, when the toner grains $T_1$ pass the secondary image transfer nip, the secondary image transfer roller 16 may be released from the belt 10 in order to prevent the toner grains T1 from depositing on the roller 16.

The toner grains $T_1$ thus moved away from the secondary image transfer nip are conveyed to a cleaning zone where they face the belt cleaner 15. In the cleaning zone, the toner grains $T_1$ are dispersed by the fur brush and then scraped off by the cleaning blade. In this manner, the toner grains $T_1$ on the belt 10 are collected by the belt cleaner 15.

As stated above, in the first modification, the toner grains $T_1$ released from the brush roller 41 are collected by way of the belt 10. This makes it needless to provide a waste toner tank for storing the toner grains $T_1$ for thereby implementing size reduction. Particularly, because the illustrative embodiment is a tandem printer including four drums 1Y through 1K, the size reduction is noticeable, compared to the conventional printer in which a particular waste toner tank is assigned to each drum.

The illustrative embodiment, causing the developing device 5 to collect the toner grains $T_1$ of opposite polarity, and the first modification, collecting the toner grains $T_1$ by way of the belt 10, may be combined. This allows the belt 10 to collect the toner grains $T_1$ that the developing device 5 failed to collect at the secondary image transfer nip. This two-stage collection enhances the toner collecting ability and therefore insures toner collection. Consequently, even a large amount of toner grains T1, which may be released from the brush roller 41 at a time, can be sufficiently collected, so that the frequency of release of toner from the brush roller 41 can be reduced.

While the first modification causes the belt cleaner 15 to collect the toner grains $T_1$ of opposite polarity transferred to the belt 10, any other collecting method may be used. For example, a bias opposite in polarity to the bias assigned to image formation is applied to the secondary image transfer roller 16 before the toner grains $T_1$ on the belt 10 reach the secondary image transfer nip. This causes the toner grains $T_1$ to deposit on the secondary image transfer roller 15 at the secondary image transfer nip. In such a case, cleaning means should be assigned to the secondary image transfer roller 16.

Figure 13:
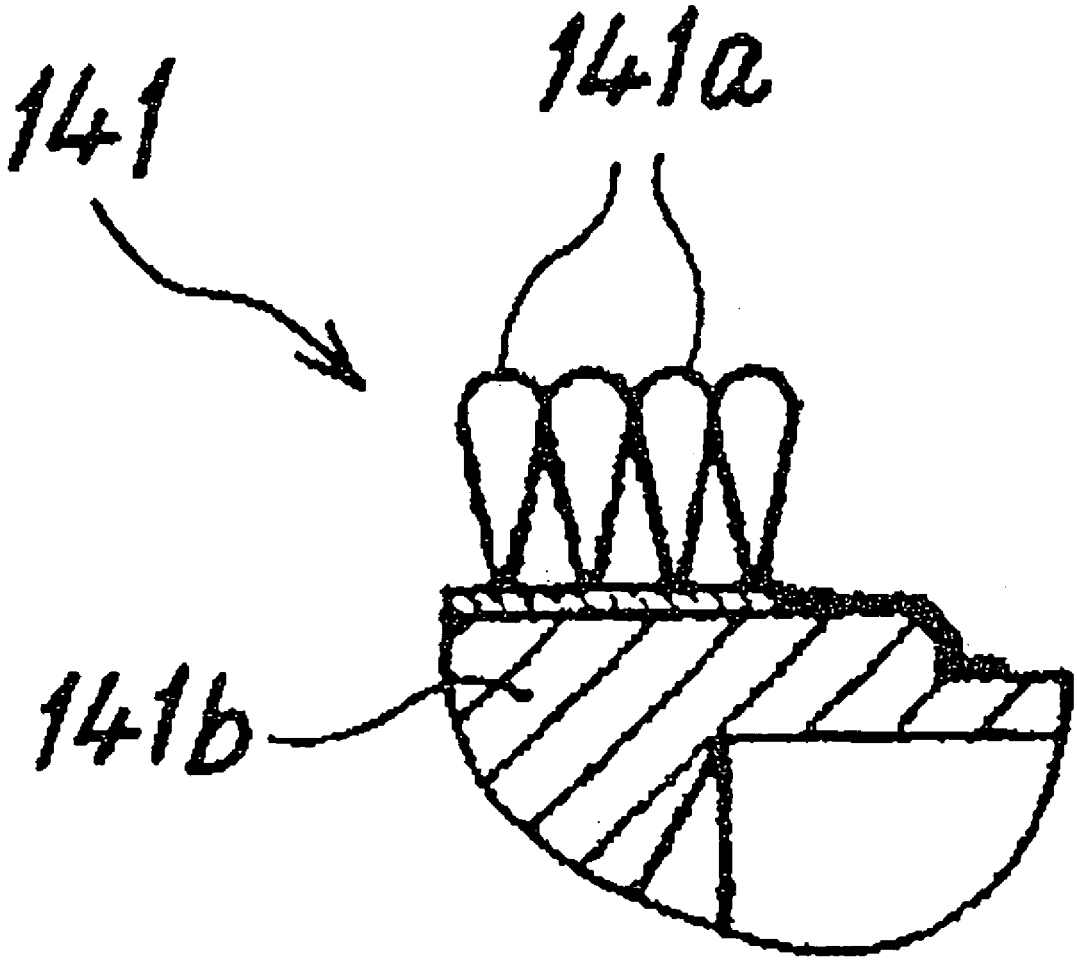
FIG. 13 is an enlarged view showing part of a brush roller particular to a second modification of the alternative embodiment.

A second modification different from the illustrative embodiment as to the configuration of the brush roller will be described hereinafter. FIG. 13 shows a brush roller 141 made up of bristles 141*a* and a shaft portion 141*b*. As shown, each bristle 141*a* is affixed to the shaft portion 141*b* at opposite ends thereof in the form of a loop. Experiments showed that such loop bristles 141*b* reduced filming more than non-loop bristles. This is presumably accounted for by the following. At least part of the bristles 141*a* rubs the surface of the drum 1 with their portions surrounded by the loops crossing the direction of rubbing. At this instant, the loop portions of the bristles 141*a* rub the surface of the drum 1 in the form of edges. The brush roller 141 can therefore scrape off the additive deposited on the drum 1 and causative of filming more efficiently than a brush roller having non-loop bristles, thereby reducing filming.

In the second modification, the brush roller 141 has loop density of 50 loops/inch$^2$ or above, but 600 loops/inch$^2$ or below. So long as the loop density lies in the above range, the brush roller 141 can exhibit the expected effect.

A third modification different from the illustrative embodiment as to the configuration of the charging device will be described with reference to FIG. 4 hereinafter. While the third modification, like the illustrative embodiment, charges the surface of the drum 1 with the contact or vicinity type of charging system, the third modification additionally includes a moving mechanism for selectively moving the charge roller into or out of contact with the drum 1. As for the rest of the configuration, the third modification is identical with the illustrative embodiment.

Figure 14:
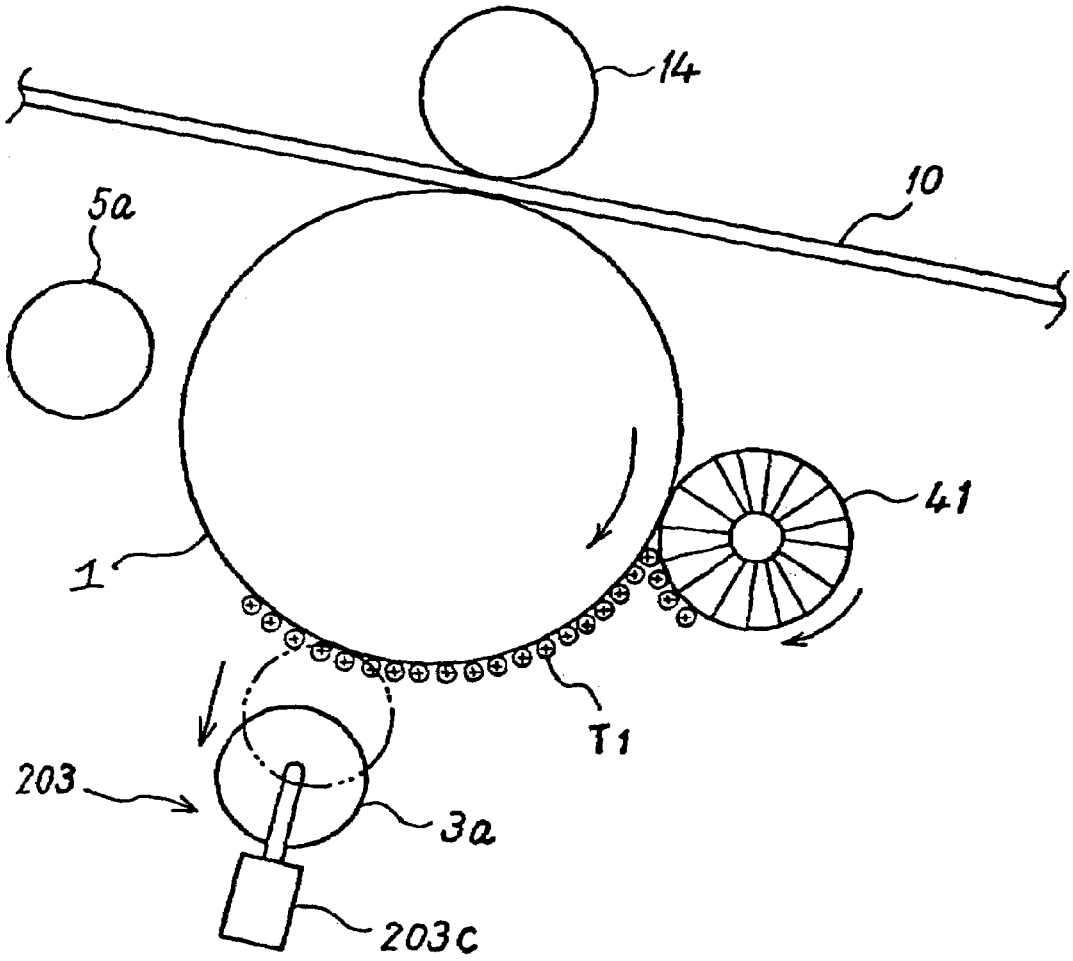
FIG. 14 shows a charging device representative of a third modification of the alternative embodiment.

As shown in FIG. 14, a charging device 203 includes a moving mechanism or releasing means 203*c* configured to release the charge roller 3*a* from the drum 1 before the toner grains $T_1$ released from the brush roller 41 to the drum 1 arrive at the contact zone where the drum 1 and charge roller 3*a* contact each other. The moving mechanism 203*c* may be implemented by any one of conventional means having the above function. In this configuration, the toner grains $T_1$ can pass the contact zone without depositing on the charge roller 3*a*. It follows that the charge start voltage between the charge roller 3*a* and the drum 1 does not vary, and therefore short image density, background contamination and irregular image density are obviated.

The first or the second modification may be combined with the third modification, if desired.

[Experiment 1]

When the additives of the toner grains, particularly silica, part from the toner grains, they deposit on the drum 1 in the form of a film, as stated earlier. The brush roller 41 can mechanically remove the additives deposited on the drum 1, as determined by experiments. Experiment 1 was conducted to determine contact pressure between the brush roller 41 and the drum 1 that allowed the brush roller 41 to sufficiently reduce filming.

In Experiment 1, filming was ranked with various brush rollers based on the first modification when 30,000 prints were produced. Rank 5 is highest while rank 1 is lowest. For the estimation of filming, a photosensor was fixed in place at a preselected distance from the surface of the drum 1 in such a manner as to receive a light beam reflected from the drum 1. A current to be fed to a light emitting device was controlled such that the quantity of light incident to the photosensor was constant. For a new drum 1 and a given reference current, the filming rank was determined to be high when the increment of the reference current was small or determined to be low when the increment was large. The filming rank was 2.5 when the above increment was 1 mA; in ranks above 2.5, filming, if any, did not cause an image to be blurred or otherwise rendered defective. In this sense, filming ranks of 2.5 and above were determined to be allowable.

Figure 15:
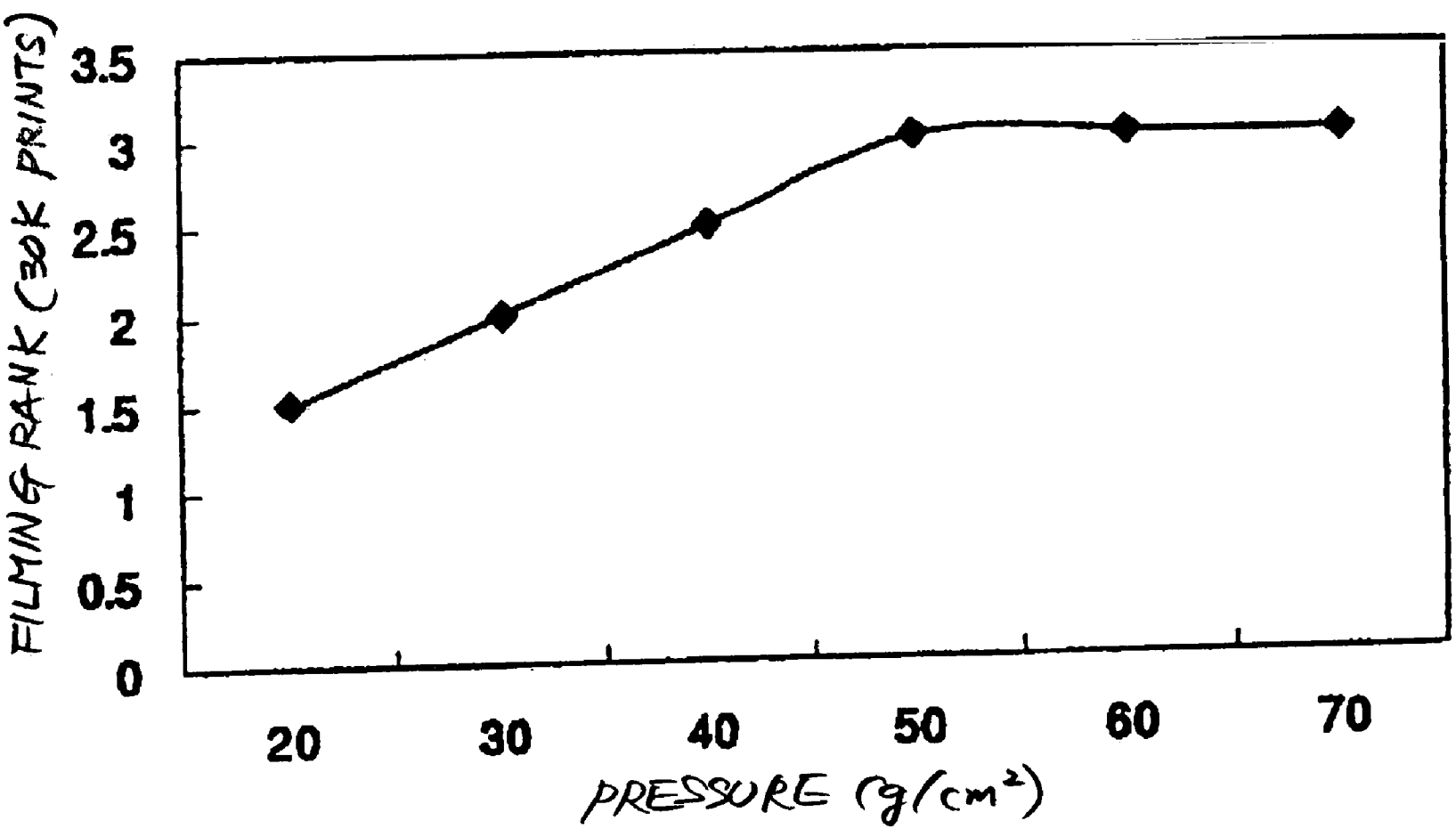
FIG. 15 is a graph showing the results of Experiment 1.

FIG. 15 is a graph showing the results of Experiment 1, i.e., a relation between the contact pressure acting between the brush roller 41 and the drum 1 and the filming rank. In Experiment 1, the linear velocity ratio of the brush roller 41 to the drum 1 was selected to be 1.2.

As FIG. 15 indicates, the higher the contact pressure, the higher the filming rank. When the contact pressure was 40 g/cm$^2$, the filming rank was 2.5; although some filming was observed on the drum 1, it did not effect image quality. Experiment 1 showed that contact pressure of 40 g/cm$^2$or above effectively obviated filming of a degree that effects image quality. It is to be noted that contact pressure of 50 g/cm$^2$ or above implements filming rank of 3.0 and therefore obviates filming more positively. It will therefore be seen that if the contact pressure is 40 g/cm$^2$ or above, preferably 50 g/cm$^2$ or above, then filming, having influence on image quality, can be effectively obviated.

If the contact pressure is excessively high, then loads necessary for driving the brush roller 41 and drum 1 increase and make it difficult to attain smooth drive or result in the need for a bulky drive source. Experiment 1 showed that filming rank did not exceed 3.0 when the contact pressure was 50 g/cm$^2$ or above. It follows that when consideration is given to the above drive loads as well, the contact pressure should preferably be between 50 g/cm$^2$ and 60 g/cm$^2$.

[Experiment 2]

Experiment 2 was conducted to estimate filming by use of brush rollers 41 each being formed of a particular material and provided with a particular configuration. More specifically, in Experiment 2, brush rollers 41 all contacted the drum 1 with pressure of 50 g/cm$^2$. As for the rest of the conditions, Experiment 2 is identical with the illustrative embodiment. FIG. 16 lists the results of Experiment 2.

In FIG. 16, a circle indicates a case wherein filming belonged to rank 2.5 or above while a cross indicates a case wherein it belonged to ranks below 2.5. Further, a triangle indicates a case wherein rank was sometimes 2.5 or above, but sometimes below 2.5, when confirmed a plurality of times.

When the bristles were formed of conductive nylon fibers and provided with sharp tips, filming rank was lowered to "X" when more than 60,000 prints were output. By contrast, when the bristles formed of conductive nylon fibers were provided with the loop configuration of the second modification, filming rank was "Δ" or above up to 70,000 prints.

When the above bristles of a normal brush roller were coated with urethane, filming rank was "Δ" or above up to 80,000 prints. When the bristles provided with sharp tips were coated with urethane, filming rank was "o" or above up to 100,000 prints.

It will therefore be seen that bristles coated with urethane implement higher filming thank than bristles not coated with urethane, and that bristles with loop tips implement higher filming rank than bristles with sharp tips.

In the illustrative embodiment and first to third modifications thereof, the polarity of the charge bias and the expected polarity of toner grains are assumed to be the same, so that the brush roller 41 or 141 is expected to collect toner grains of opposite polarity. When the above two polarities are opposite to each other, the brush roller 41 or 141 will, of course, collect toner grains of expected polarity. That is, in the illustrative embodiment and modifications thereof, the bias applied to the brush roller 41 or 141 may be of the same polarity as the charge bias, so that the brush roller 41 or 141 can collect toner grains of opposite polarity before the toner grains arrive at the charging member.

As stated above, the illustrative embodiment and modifications thereof sufficiently cope with filming while making the most of the advantages of the bladeless type of cleaning system.

Various modifications will become possible for those skilled in the art after receiving the teachings of the present disclosure without departing from the scope thereof.

What is claimed is:

1. In an image forming apparatus for causing a charging member, applied with a charge bias of preselected polarity, to uniformly charge a surface of an image carrier in contact with or in the vicinity of said surface to thereby form a latent image, developing said latent image with toner to thereby produce a corresponding toner image, and electrostatically transferring said toner image to a recording medium, temporary holding means is provided for causing a brush member, which contacts said surface of said image carrier with bristles, to collect, among residual toner grains left on said surface after transfer of the toner image, toner grains of opposite polarity opposite to said preselected polarity from said surface when applied with a hold bias of a same polarity as said preselected polarity and release said toner grains of opposite polarity to said surface at a preselected timing when applied with a release bias of polarity opposite to said preselected polarity, and said surface and said bristles contact each other under a pressure of 40 g/cm$^2$ or above.

2. The apparatus as claimed in claim 1, wherein the pressure is 50 g/cm$^2$ or above.

3. The apparatus as claimed in claim 2, wherein the pressure is 60 g/cm$^2$ or below.

4. The apparatus as claimed in claim 1, wherein the bristles have loop-like tips.

5. The apparatus as claimed in claim 1, wherein the bristles are coated with urethane.

6. The apparatus as claimed in claim 1, a process cartridge is removably mounted to a body of said apparatus and comprises at least said image carrier and said brush member.

7. In a process cartridge removably mounted to a body of an image forming apparatus configured to cause a charging member, applied with a charge bias of preselected polarity, to uniformly charge a surface of an image carrier in contact with or in the vicinity of said surface to thereby form a latent image, develop said latent image with toner to thereby produce a corresponding toner image, and electrostatically transfer said toner image to a recording medium, said image forming apparatus comprising temporary holding means for causing a brush member, which contacts said surface of said image carrier with bristles, to collect, among residual toner grains left on said surface after transfer of the toner image, toner grains of opposite polarity opposite to said preselected polarity from said surface when applied with a hold bias of a same polarity as said preselected polarity and release said toner grains of opposite polarity to said surface at a preselected timing when applied with a release bias of polarity opposite to said preselected polarity, said surface and said bristles contacting each other under a pressure of 40 g/cm$^2$ or above, at least said image carrier and said brush member are constructed integrally with each other.

* * * * *